US007090331B2

(12) United States Patent
Karasawa et al.

(10) Patent No.: US 7,090,331 B2
(45) Date of Patent: Aug. 15, 2006

(54) PRINTING METHOD, PRINTING APPARATUS, AND COMPUTER-READABLE STORAGE MEDIUM

(75) Inventors: Toshio Karasawa, Nagano-ken (JP); Yuken Tanabe, Nagano-ken (JP); Takayuki Ishii, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 251 days.

(21) Appl. No.: 10/845,510

(22) Filed: May 14, 2004

(65) Prior Publication Data

US 2005/0002717 A1 Jan. 6, 2005

(30) Foreign Application Priority Data

May 15, 2003 (JP) ..... 2003-137538
Oct. 22, 2003 (JP) ..... 2003-362010

(51) Int. Cl.
*B41J 2/15* (2006.01)
*B41J 2/205* (2006.01)

(52) U.S. Cl. ..... 347/41; 347/15

(58) Field of Classification Search ..... 347/41
See application file for complete search history.

(56) References Cited

U.S. PATENT DOCUMENTS 4,063,254 A 12/1977 Fox et al.
4,198,642 A 4/1980 Gamblin
6,010,207 A * 1/2000 Fuwa ..... 347/43
6,164,745 A * 12/2000 Nagoshi et al. ..... 347/41
6,183,055 B1 * 2/2001 Kanematsu et al. ..... 347/9

FOREIGN PATENT DOCUMENTS

JP 53-2040 1/1978
JP 3-207665 A 9/1991
JP 4-19030 B2 3/1992

* cited by examiner

*Primary Examiner*—Lamson Nguyen
*Assistant Examiner*—Jannelle M. Lebron
(74) *Attorney, Agent, or Firm*—Sughrue Mion, PLLC

(57) ABSTRACT

A printing method comprises the steps of: in a first movement, moving a print head to form dots on a medium at aperiodic intervals in a moving direction of the print head, wherein the print head includes N pieces of nozzles arranged at a constant pitch in a direction that intersects with the moving direction, wherein the N pieces of nozzles are for forming N dots of a same color, and wherein N is an integer of at least two; in second through M-th movements, moving the print head to form, on the medium, the rest of the dots that were not formed in the first movement, wherein M is an integer of at least two; and repeating the first through M-th movements to print information on the medium.

25 Claims, 33 Drawing Sheets

137

| | | | | | | | | | | | |
|---|---|---|---|---|---|---|---|---|---|---|---|
| N4 (4) | 1 | 0 | 0 | 1 | 1 | 0 | 0 | 0 | 1 | 1 | 137d |
| N3 (3) | 0 | 1 | 0 | 0 | 1 | 1 | 0 | 1 | 1 | 0 | 137c |
| N2 (2) | 0 | 1 | 1 | 0 | 0 | 1 | 1 | 1 | 0 | 0 | 137b |
| N1 (1) | 1 | 0 | 1 | 1 | 0 | 0 | 1 | 0 | 0 | 1 | 137a |

FIG. 7

137

| | | | | | | | | | | | |
|---|---|---|---|---|---|---|---|---|---|---|---|
| N4 (4) | 1 | 0 | 0 | 1 | 1 | 0 | 0 | 0 | 1 | 1 | 137d |
| N3 (3) | – | – | – | – | – | – | – | – | – | – | 137c |
| N2 (2) | – | – | – | – | – | – | – | – | – | – | 137b |
| N1 (1) | 0 | 1 | 1 | 0 | 0 | 1 | 1 | 1 | 0 | 0 | 137a |

FIG. 20

PRINTING METHOD, PRINTING APPARATUS, AND COMPUTER-READABLE STORAGE MEDIUM

CROSS-REFERENCE TO RELATED APPLICATIONS

The present application claims priority upon Japanese Patent Application No. 2003-137538 filed May 15, 2003 and Japanese Patent Application No. 2003-362010 filed Oct. 22, 2003, the contents of which are herein incorporated by reference.

BACKGROUND OF THE INVENTION

1. Field of the Invention

The present invention relates to printing methods, printing apparatuses, and computer-readable storage media.

2. Description of the Related Art

Straight-feed printers (in which a medium is carried straightly) and drum-feed printers (in which a medium is carried while being bore on a drum) are known as printing apparatuses that perform printing by moving (or "scanning") a print head in a moving direction (or "main-scanning direction"). U.S. Pat. No. 4,198,642 and Japanese Patent Application Laid-open Publication No. 53-2040 disclose a technique, which is referred to as the "interlace scheme", for improving the image quality of such types of printers, and in particular, inkjet printers.

FIG. 29 is a diagram for illustrating an example of the interlace scheme. It should be noted that the following parameters are used in the present specification for defining each printing scheme:

N: number of nozzles (pieces)

k: nozzle pitch (dot pitch)

s: number of times scanning is repeated

D: nozzle density (pieces/inch)

L: sub-scanning pitch (inch)

w: dot pitch (inch)

The number of nozzles N (pieces) is the number of pieces of nozzles that are used for forming dots, and indicates the maximum number of nozzles that can be used upon one scanning movement in the main-scanning direction. In the example of FIG. 29, N=3. The nozzle pitch k (dot pitch) indicates the number of pitches of a printed image (i.e., the number of dot pitches w) that amounts to an interval between the centers of two nozzles in the print head. In the example of FIG. 29, k=2. The number of times scanning is repeated s (times) indicates the number of times of main-scanning movements required for filling up one main-scan line with dots. In the example of FIG. 29, each main-scan line is filled up with one main-scanning movement, and therefore, s=1. As described in detail below, if s is two or more, then dots will be formed intermittently in the main-scanning direction. The nozzle density D (pieces/inch) indicates the number of nozzles arranged per inch in a nozzle array of the print head. The sub-scanning pitch L (inch) indicates the distance over which a medium is moved per one sub-scanning movement. The dot pitch w (inch) indicates the pitch between dots in a printed image. It should be noted that generally, $w=1/(D\cdot k)$ and $k=1/(D\cdot w)$ hold true.

In FIG. 29, the circles, each containing a two-digit number, indicate the positions at which dots are printed. As indicated by the legend shown in FIG. 29, the number on the left, of the two-digit number in one circle, indicates the nozzle number, and the number on the right indicates the printing order (i.e., the number of the main-scanning movement during which that dot was printed).

The interlace scheme shown in FIG. 29 features the nozzle array configuration in the print head and the way in which sub-scanning movement is performed. More specifically, according to the interlace scheme, the nozzle pitch k, which indicates the interval between the centers of two adjacent nozzles, is set to be an integer of two or more, and coprime integers are selected as the number of nozzles N and the nozzle pitch k. Further, the sub-scanning pitch L is set to $N/(D\cdot k)$ $(=N\cdot w)$.

The interlace scheme is advantageous in that it is possible to disperse, over the printed image, variations in nozzle pitch, ink ejection characteristics, and so forth. Therefore, even if there are variations in nozzle pitch and/or ejection characteristics, the interlace scheme has the effect of being able to lessen the influence caused by such variations, thus improving image quality.

Japanese Patent Application Laid-open Publication No. 3-207665 and Japanese Patent Application Examined Publication No. 4-19030 disclose another technique, which is referred to as the "overlapping scheme" or the "multi-scan scheme", aimed at improving the image quality of color inkjet printers.

FIG. 30 is a diagram for illustrating an example of the overlapping scheme. In the overlapping scheme of this example, eight nozzles are divided into two nozzle groups. The first nozzle group is made up of the four nozzles whose nozzle numbers (i.e., the numbers on the left in each circle) are even, and the second nozzle group is made up of the four nozzles whose nozzle numbers are odd. In the first main-scanning movement, dots are formed in the main-scanning direction at intervals of (s−1) dots by driving each nozzle group at intermittent timings. In the example of FIG. 30, every other dot is formed because s=2. Further, the timings for driving each nozzle group are controlled such that each group forms dots at different positions in the main-scanning direction. More specifically, as shown in FIG. 30, between the nozzles in the first nozzle group (with nozzle numbers 8, 6, 4, and 2) and the nozzles in the second nozzle group (with nozzle numbers 7, 5, 3, and 1), the printing positions are misaligned in the main-scanning direction by one dot pitch. By performing the main-scanning movements for a plurality of times and shifting the timing for driving the nozzle groups per each main-scanning movement, all dots of each main-scan line are formed.

With the overlapping scheme, the dots of a main-scan line are not printed by a single nozzle, but they are printed using several nozzles. Therefore, even if there are variations in nozzle characteristics (such as characteristics in pitch and/or ejection), it is possible to prevent such characteristics of a specific nozzle from affecting the whole main-scan line, and thus, it is possible to improve image quality.

In printers that perform printing by driving a print head in the main-scanning direction, there are situations in which "banding" (i.e., unevenness in printing that appears in band-like strips) occurs due to misalignment of the angle at which the print head is mounted.

FIG. 31 is a diagram for illustrating how banding occurs. In this example, the values for the print head 200 are set as follows: number of nozzles N=4; k=2; s=2; D=360 (dpi); and as for the sub-scanning pitch L, two kinds of values, i.e., a value that is 3/2 times the nozzle pitch k and a value that is half the nozzle pitch k, are mixed. It should be noted that the matrix-like outer border 210 shown in FIG. 31 is only for elucidating the dot forming positions.

In the example of FIG. 31, the left end of the outer border 210 is regarded as the starting position, and during the first scanning movement, four dots are formed at two-dot intervals in the sub-scanning direction, and dots are formed at two-dot intervals in the main-scanning direction. After a sub-scanning movement for a distance amounting to 3/2 times the nozzle pitch is carried out, dots are formed in the same way as described above, taking the left end of the outer border 210 as the starting position as in the first scanning movement. Then, after a sub-scanning movement for a distance amounting to half the nozzle pitch is carried out, dots are formed in the same way as described above, taking the position that is shifted from the left end of the outer border 210 towards the right by one dot as the starting position. Next, after a sub-scanning movement for a distance amounting to 3/2 times the nozzle pitch is carried out, dots are formed in the same way as described above, taking the position that is shifted from the left end of the outer border 210 towards the right by one dot as the starting position.

The matrix-like area within the outer border 210 is filled in by repeating the above-described operations.

FIG. 32 is a diagram showing how dots are formed according to the same printing method as FIG. 31, but when the print head 200 is tilted by an angle θ. As shown in FIG. 32, if the print head 200 is tilted by the angle θ, then at the upper end of the print head 200, the dots that have been formed are shift towards the left, whereas at the lower end, the dots are shifted towards the right. Thus, as shown in FIG. 33, in some positions of the dots, there appear sections 220 in which the dots are densely gathered and sections 230 in which the dots are sparsely scattered. These sections are recognized respectively as sections with high density and sections with low density compared to peripheral sections, and this causes deterioration in image quality.

SUMMARY OF THE INVENTION

The present invention has been made in view of the above and other problems. An object thereof is to achieve a printing method, a printing apparatus, and a computer-readable storage medium having recorded thereon a printing program, which are capable of preventing occurrence of banding, even when the print head is tilted. Another object thereof is to achieve a printing method, a printing apparatus, and a computer-readable storage medium having recorded thereon a printing program, which are capable of preventing occurrence of banding, without giving rise to a decrease in printing speed, even when the print head is tilted.

An aspect of the present invention aimed at accomplishing at least some of the above and other objects is a printing method comprising the steps of:

in a first movement, moving a print head to form dots on a medium at aperiodic intervals in a moving direction of the print head, wherein the print head includes N pieces of nozzles arranged at a constant pitch in a direction that intersects with the moving direction, wherein the N pieces of nozzles are for forming N dots of a same color, and wherein N is an integer of at least two;

in second through M-th movements, moving the print head to form, on the medium, the rest of the dots that were not formed in the first movement, wherein M is an integer of at least two; and repeating the first through M-th movements to print information on the medium.

Another aspect of the present invention aimed at accomplishing at least some of the above and other objects is a printing method comprising the steps of:

subjecting image data that is used for forming dots on a medium with at least one nozzle formed at an upper end, in a predetermined direction, of a print head to a first dispersion process using dispersion data, wherein the print head is movable in a moving direction, wherein the predetermined direction is a direction that intersects with the moving direction, wherein the print head includes N pieces of nozzles arranged at a constant pitch in the predetermined direction, wherein the N pieces of nozzles are for forming N dots of a same color on the medium, wherein N is an integer of at least two, and wherein the dispersion data is for a periodically dispersing image data that is used for forming dots in one movement of the print head;

subjecting image data that is used for forming dots on the medium with at least one nozzle formed at a lower end, in the predetermined direction, of the print head to a second dispersion process using data that is obtained by inverting the dispersion data used for the first dispersion process; and supplying the image data that has been subjected to the first dispersion process, the image data that has been subjected to the second dispersion process, and image data corresponding to the nozzles that are not targeted for the first dispersion process nor the second dispersion process to the print head.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein:

FIG. 7 is a diagram showing contents of a dispersion table shown in FIG. 4, and shows details on dispersion data that correspond to each of the nozzles in a print head;

FIG. 20 is a diagram showing contents of another example of a dispersion table shown in FIG. 4, and shows details on dispersion data that correspond to each of the nozzles in a print head;

DETAILED DESCRIPTION OF THE INVENTION

Figure 1:
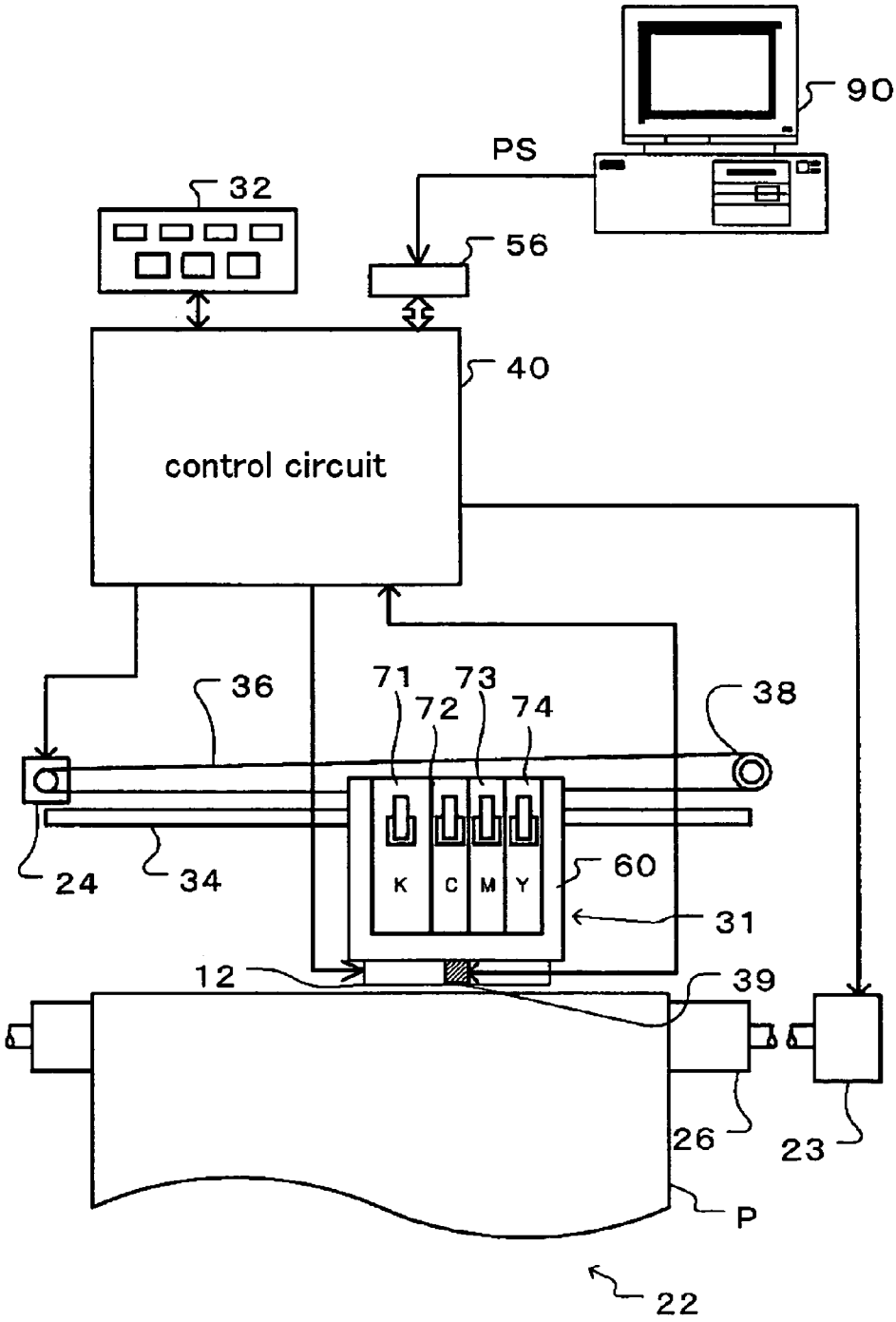
FIG. 1 is a diagram schematically showing a configuration of main components of a printing apparatus according to an embodiment of the present invention.

At least the following matters will be made clear by the explanation in the present specification and the description of the accompanying drawings.

An aspect of the present invention is a printing method comprising the steps of:

in a first movement, moving a print head to form dots on a medium at aperiodic intervals in a moving direction of the print head, wherein the print head includes N pieces of nozzles arranged at a constant pitch in a direction that intersects with the moving direction, wherein the N pieces of nozzles are for forming N dots of a same color, and wherein N is an integer of at least two; and in second through M-th movements, moving the print head to form, on the medium, the rest of the dots that were not formed in the first movement, wherein M is an integer of at least two; and repeating the first through M-th movements to print information on the medium.

In this way, it becomes possible to prevent occurrence of banding, even when the print head is tilted.

Further, each dot row that is formed on the medium and that is aligned in the moving direction may be formed during the first through M-th movements by at least two different ones of the nozzles. In this way, it becomes possible to prevent occurrence of banding certainly by dispersing the influence due to tilting of the print head.

Further, during the first through M-th movements, interlace printing may be performed by carrying the medium at least once for a distance that corresponds to a value obtained by multiplying an integer to half the distance of the pitch at which the nozzles are arranged. In this way, it is possible to effectively prevent occurrence of banding that is caused by misalignment, in the sub-scanning direction, in the positions at which dots are formed.

Further, during the first through M-th movements, interlace printing may be performed by forming a portion of the dots in a dot row by using the N pieces of nozzles at predetermined intervals during one movement, and forming the rest of the dots in the dot row by using the rest of the N pieces of nozzles during the rest of the movements. In this way, it is possible to effectively prevent occurrence of banding that is caused by misalignment, in the sub-scanning direction, in the positions at which dots are formed.

Further, a print pattern for dots formed in the moving direction during each of the first through M-th movements may be different for each of the N pieces of nozzles. In this way, it is possible to prevent occurrence of banding advantageously, even when the print head is tilted, by certainly dispersing the positions at which dots are formed.

Further, a print pattern for dots formed in the moving direction during each of the first through M-th movements may be different for each color. In this way, it is possible to prevent occurrence of banding advantageously, even when the print head is tilted, by certainly dispersing for each color the positions at which dots are formed.

Further, the printing method may further comprise: preparing at least two print heads; and performing a portion of the first through M-th movements with one of the print heads, and performing another portion of the first through M-th movements with another of the print heads. In this way, it is possible to prevent occurrence of banding certainly, and also increase printing speed.

Further, print data that is to be supplied to each of the nozzles may be generated from original image data by using dispersion data stored in a dispersion table. In this way, it becomes possible to generate the print data at high speed.

Further, in the dispersion data, values "1" each indicating that a dot is to be formed, and values "0" each indicating that no dot is to be formed may be arranged in a matrix; and the print data may be generated by multiplying the dispersion data and the original image data. Since it is possible to generate the print data through bit calculation, it becomes possible to increase processing speed.

Further, if the size of the original image data is larger than the size of the dispersion data, then the original image data may be divided into a plurality of areas each corresponding to the size of the dispersion data, and the dispersion data may be multiplied to each of the areas. In this way, the storage capacity necessary for storing the dispersion data can be reduced.

Another aspect of the present invention is a printing method comprising the steps of: in a first movement, moving a print head to form dots on a medium at aperiodic intervals in a moving direction of the print head, wherein the print head includes N pieces of nozzles arranged at a constant pitch in a direction that intersects with the moving direction, wherein the N pieces of nozzles are for forming N dots of a same color, and wherein N is an integer of at least two; in second through M-th movements, moving the print head to form, on the medium, the rest of the dots that were not formed in the first movement, wherein M is an integer of at least two; and repeating the first through M-th movements to print information on the medium, wherein: each dot row that is formed on the medium and that is aligned in the moving direction is formed during the first through M-th movements by at least two different ones of the nozzles; during the first through M-th movements, interlace printing is performed by carrying the medium at least once for a distance that corresponds to a value obtained by multiplying an integer to half the distance of the pitch at which the nozzles are arranged; during the first through M-th movements, interlace printing is performed by forming a portion of the dots in a dot row by using the N pieces of nozzles at predetermined intervals during one movement, and forming the rest of the dots in the dot row by using the rest of the N pieces of nozzles during the rest of the movements; a print pattern for dots formed in the moving direction during each of the first through M-th movements is different for each of the N pieces of nozzles; a print pattern for dots formed in the moving direction during each of the first through M-th movements is different for each color; the method further comprises: preparing at least two print heads; and performing a portion of the first through M-th movements with one of the print heads, and performing another portion of the first through M-th movements with another of the print heads; print data that is to be supplied to each of the nozzles is generated from original image data by using dispersion data stored in a dispersion table; in the dispersion data, values "1" each indicating that a dot is to be formed, and values "0" each indicating that no dot is to be formed are arranged in a matrix; the print data is generated by multiplying the dispersion data and the original image data; and if the size of the original image data is larger than the size of the dispersion data, then the original image data is divided into a plurality of areas each corresponding to the size of the dispersion data, and the dispersion data is multiplied to each of the areas.

In this way, it is possible to achieve substantially all of the effects described above.

Another aspect of the present invention is a printing apparatus comprising: a print head that is movable in a moving direction and that includes N pieces of nozzles arranged at a constant pitch in a direction intersecting with the moving direction, wherein the N pieces of nozzles are for forming N dots of a same color, and wherein N is an integer of at least two; and a controller for controlling movement of the print head, wherein: in a first movement, the controller moves the print head in the moving direction and makes the print head form dots on a medium at aperiodic intervals in the moving direction; in second through M-th movements, the controller moves the print head in the moving direction and makes the print head form, on the medium, the rest of the dots that were not formed in the first movement, wherein M is an integer of at least two; and the controller makes the print head repeat the first through M-th movements to print information on the medium.

With this printing apparatus, it becomes possible to prevent occurrence of banding, even when the print head is tilted.

It is also possible to achieve a computer-readable storage medium having recorded thereon a computer program for a printing apparatus including a print head that is movable in a moving direction and that includes N pieces of nozzles arranged at a constant pitch in a direction intersecting with the moving direction, wherein the N pieces of nozzles are for forming N dots of a same color, and wherein N is an integer of at least two, the computer program causing the printing apparatus to achieve functions of: in a first movement, moving the print head in the moving direction and causing the print head to form dots on a medium at aperiodic intervals in the moving direction; in second through M-th movements, moving the print head in the moving direction and causing the print head to form, on the medium, the rest of the dots that were not formed in the first movement, wherein M is an integer of at least two; and causing the print head to repeat the first through M-th movements to print information on the medium.

In this way, it becomes possible to prevent occurrence of banding, even when the print head is tilted.

Another aspect of the present invention is a printing method comprising the steps of:

subjecting image data that is used for forming dots on a medium with at least one nozzle formed at an upper end, in a predetermined direction, of a print head to a first dispersion process using dispersion data, wherein the print head is movable in a moving direction, wherein the predetermined direction is a direction that intersects with the moving direction, wherein the print head includes N pieces of nozzles arranged at a constant pitch in the predetermined direction, wherein the N pieces of nozzles are for forming N dots of a same color on the medium, wherein N is an integer of at least two, and wherein the dispersion data is for aperiodically dispersing image data that is used for forming dots in one movement of the print head;

subjecting image data that is used for forming dots on the medium with at least one nozzle formed at a lower end, in the predetermined direction, of the print head to a second dispersion process using data that is obtained by inverting the dispersion data used for the first dispersion process; and supplying the image data that has been subjected to the first dispersion process, the image data that has been subjected to the second dispersion process, and image data corresponding to the nozzles that are not targeted for the first dispersion process nor the second dispersion process to the print head.

In this way, it becomes possible to prevent occurrence of banding, without giving rise to a decrease in printing speed, even when the print head is tilted.

Further, the medium may be carried to form, on the medium, a line of dots by superposing dots corresponding to the image data that has been subjected to the first dispersion process and dots corresponding to the image data that has been subjected to the second dispersion process. In this way, scan lines are formed by dots that are created by different nozzles, and thus, it is possible to prevent occurrence of banding certainly.

Further, interlace printing may be performed by alternately using the N pieces of nozzles at predetermined intervals. In this way, dots that are adjacent to each other in the vertical direction will be formed by different nozzles, and thus, it becomes possible to prevent occurrence of banding certainly.

Further, the number of nozzles to be targeted for the dispersion process may be increased or decreased according to an amount of tilt of the print head. In this way, by increasing the number of nozzles that are to be subjected to the dispersion process when the amount of tilt of the print head is large, it becomes possible to prevent occurrence of banding efficiently.

Further, the dispersion data used for the first dispersion process may be made up of a plurality of pieces of data that differ for each color. In this way, by carrying out the dispersion process using dispersion data that differ for each color, it becomes possible to prevent occurrence of banding effectively.

Further, the printing method may further comprise: preparing at least two print heads; and supplying the image data that has been subjected to the first dispersion process to one of the print heads, and supplying the image data that has been subjected to the second dispersion process to another of the print heads. In this way, by performing printing using a plurality of print heads, it becomes possible to shorten the time necessary for performing printing.

Further, the dispersion data may be made up of values "1" each indicating that a dot is to be formed, and values "0" each indicating that no dot is to be formed; the first dispersion process may be performed by multiplying the image data and the dispersion data; and the second dispersion process may be performed by multiplying the image data and the data that is obtained by inverting the dispersion data. In this way, it is possible to execute the dispersion process through calculation of bits, and thus, it becomes possible to increase processing speed.

Further, the data used in the second dispersion process may be obtained by inverting the bits in the dispersion data used for the first dispersion process. In this way, the storage area for storing the dispersion data can be reduced.

Further, if the size of the image data is larger than the size of the dispersion data, then, in the first dispersion process and the second dispersion process, the image data may be divided into a plurality of areas each corresponding to the size of the dispersion data, and the dispersion data, or the data that is obtained by inverting the dispersion data, may be multiplied to each of the areas. In this way, it becomes possible to reduce the amount of dispersion data, and thus, the storage area for storing the dispersion data can be reduced.

Another aspect of the present invention is a printing method comprising the steps of: subjecting image data that is used for forming dots on a medium with at least one nozzle formed at an upper end, in a predetermined direction, of a print head to a first dispersion process using dispersion data, wherein the print head is movable in a moving direction, wherein the predetermined direction is a direction that intersects with the moving direction, wherein the print head includes N pieces of nozzles arranged at a constant pitch in the predetermined direction, wherein the N pieces of nozzles are for forming N dots of a same color on the medium, wherein N is an integer of at least two, and wherein the dispersion data is for aperiodically dispersing image data that is used for forming dots in one movement of the print head; subjecting image data that is used for forming dots on the medium with at least one nozzle formed at a lower end, in the predetermined direction, of the print head to a second dispersion process using data that is obtained by inverting the dispersion data used for the first dispersion process; and supplying the image data that has been subjected to the first dispersion process, the image data that has been subjected to the second dispersion process, and image data corresponding to the nozzles that are not targeted for the first dispersion process nor the second dispersion process to the print head, wherein: the medium is carried to form, on the medium, a line of dots by superposing dots corresponding to the image data that has been subjected to the first dispersion process and dots corresponding to the image data that has been subjected to the second dispersion process; interlace printing is performed by alternately using the N pieces of nozzles at predetermined intervals; the number of nozzles to be targeted for the dispersion process is increased or decreased according to an amount of tilt of the print head; the dispersion data used for the first dispersion process is made up of a plurality of pieces of data that differ for each color; the method further comprises the steps of: preparing at least two print heads; and supplying the image data that has been subjected to the first dispersion process to one of the print heads, and supplying the image data that has been subjected to the second dispersion process to another of the print heads; the dispersion data is made up of values "1" each indicating that a dot is to be formed, and values "0" each indicating that no dot is to be formed; the first dispersion process is performed by multiplying the image data and the dispersion data; the second dispersion process is performed by multiplying the image data and the data that is obtained by inverting the dispersion data; the data used in the second dispersion process is obtained by inverting the bits in the dispersion data used for the first dispersion process; and if the size of the image data is larger than the size of the dispersion data, then, in the first dispersion process and the second dispersion process, the image data is divided into a plurality of areas each corresponding to the size of the dispersion data, and the dispersion data, or the data that is obtained by inverting the dispersion data, is multiplied to each of the areas.

In this way, it is possible to achieve substantially all of the effects described above.

Another aspect of the present invention is a printing apparatus comprising: a print head that is movable in a moving direction and that includes N pieces of nozzles arranged at a constant pitch in a predetermined direction intersecting with the moving direction, wherein the N pieces of nozzles are for forming N dots of a same color on a medium, and wherein N is an integer of at least two; and a controller for controlling movement of the print head, wherein: the controller subjects image data that is used for forming dots on the medium with at least one nozzle formed at an upper end, in the predetermined direction, of the print head to a first dispersion process using dispersion data, wherein the dispersion data is for aperiodically dispersing the image data that is used for forming dots in one movement of the print head; the controller subjects image data that is used for forming dots on the medium with at least one nozzle formed at a lower end, in the predetermined direction, of the print head to a second dispersion process using data that is obtained by inverting the dispersion data used for the first dispersion process; and the controller supplies the image data that has been subjected to the first dispersion process, the image data that has been subjected to the second dispersion process, and image data corresponding to the nozzles that are not targeted for the first dispersion process nor the second dispersion process to the print head.

With this printing apparatus, it becomes possible to prevent occurrence of banding, without giving rise to a decrease in printing speed, even when the print head is tilted.

It is also possible to achieve a computer-readable storage medium having recorded thereon a computer program for a printing apparatus including a print head that is movable in a moving direction and that includes N pieces of nozzles arranged at a constant pitch in a predetermined direction intersecting with the moving direction, wherein the N pieces of nozzles are for forming N dots of a same color on a medium, and wherein N is an integer of at least two, the computer program causing the printing apparatus to achieve functions of: subjecting image data that is used for forming dots on the medium with at least one nozzle formed at an upper end, in the predetermined direction, of the print head to a first dispersion process using dispersion data, wherein the dispersion data is for aperiodically dispersing the image data that is used for forming dots in one movement of the print head; subjecting image data that is used for forming dots on the medium with at least one nozzle formed at a lower end, in the predetermined direction, of the print head to a second dispersion process using data that is obtained by inverting the dispersion data used for the first dispersion process; and supplying the image data that has been subjected to the first dispersion process, the image data that has been subjected to the second dispersion process, and image data corresponding to the nozzles that are not targeted for the first dispersion process nor the second dispersion process to the print head.

In this way, it becomes possible to prevent occurrence of banding, without giving rise to a decrease in printing speed, even when the print head is tilted.

===Configuration Example of Printing Apparatus===

An embodiment of the present invention is described below with reference to the drawings.

First, an overview of a printing apparatus is described with reference to FIG. 1 and FIG. 2. It should be noted that the combination of a printer 22 and a computer 90 is referred to as the "printing apparatus" below.

<Configuration Example of Printer 22>

FIG. 1 is a schematic configuration diagram of the printer 22 that structures the printing apparatus. FIG. 2 is a block diagram showing a configuration example of main components of the printer 22, centering on a control circuit 40.

As shown in FIG. 1, the printer 22 includes a sub-scan carrying mechanism for carrying print paper P with a paper feed motor 23, and a main-scan carrying mechanism for moving a carriage 31 back and forth in the axial direction of a paper feed roller 26 with a carriage motor 24. The direction in which the print paper P is fed by the sub-scan carrying mechanism is herein referred to as the "sub-scanning direction", and the direction in which the carriage 31 is moved by the main-scan carrying mechanism is referred to as the "main-scanning direction".

The printer 22 also includes: a print head unit 60 that is mounted on the carriage 31 and that has a print head 12; a head drive mechanism for driving the print head unit 60 to control ink ejection and dot formation; and a control circuit 40 that manages signal exchange among the paper feed motor 23, the carriage motor 24, the print head unit 60, and a control panel 32.

Next, the configuration of the print head 12 is described with reference to FIG. 1.

As shown in FIG. 1, on the carriage 31, four ink cartridges 71 through 74, that is, a cartridge 71 containing black (K) ink, a cartridge 72 containing cyan (C) ink, a cartridge 73 containing magenta (M) ink, and a cartridge 74 containing yellow (Y) ink, are detachably mounted.

The print head 12 is provided on the bottom section of the carriage 31, and nozzle rows are formed in the print head 12. The nozzle rows each correspond to the different colors of ink, and in each nozzle row, nozzles which serve as ink ejecting sections are arranged in a row in the carrying direction of the print paper P. These nozzles serve as dot forming elements.

Further, as for each nozzle row, which is provided in the bottom section of the carriage 31 and which corresponds to each of the different kinds of ink, a piezoelectric element is arranged for each nozzle. The piezoelectric element is a type of an electrostrictive element and has a good responsiveness. The piezoelectric element is provided at a position where it contacts a member that forms an ink passage for guiding the ink to the nozzle. The piezoelectric element causes deformation in the crystal structure when a voltage is applied and is thereby capable of performing conversion between electrical and mechanical energy at an extremely high speed.

In the present embodiment, by applying a voltage between electrodes provided on both ends of the piezoelectric element at predetermined time intervals, the piezoelectric element expands during the period of time in which the voltage is applied, and thus causes the wall of the ink passage on one side to deform. As a result, the volume of the ink passage decreases according to the expansion of the piezoelectric element, and ink amounting to this volume decrease is ejected, as ink droplets, at high speed from the tip of the nozzle. The ink droplets soak into the print paper P that lies over the paper feed roller 26 to thereby form dots and perform printing. The size of the ink droplets can be varied by changing the way of applying the voltage to the piezoelectric element. Thus, it is possible, for example, to form dots in three different sizes, i.e., large, medium, and small.

The control circuit 40, which serves as a controller, a portion of a first driving means, a portion of a second driving means, as well as a portion of a repeating means, is connected to the computer 90 via a connector 56. As described further below, the computer 90 has installed a driver program for the printer 22 and serves as a user interface for accepting user commands that are input through operation of input devices, such as a keyboard and a mouse, and for presenting to the user various kinds of information about the printer 22 by displaying a screen on a display device.

The sub-scan carrying mechanism for carrying the print paper P has a gear train (not shown) for transmitting the rotation of the paper feed motor 23 to the paper feed roller 26 and a paper carrying roller (not shown).

Further, the main-scan carrying mechanism for moving the carriage 31 back and forth has: a slide shaft 34 that is bridged over the paper feed roller 26 in a direction parallel to the axis of the paper feed roller 26 and that slidably holds the carriage 31; a pulley 38 between which and the carriage motor 24 is stretched an endless drive belt 36; and an optical sensor 39 for detecting the home position (the position of origin) of the carriage 31 and for detecting a print correction pattern, which is described later. It should be noted that the optical sensor 39 is structured of a light source that emits light onto the print paper P, and a line sensor (or CCD elements) for converting the light reflected from the print paper P into corresponding image signals.

Figure 2:
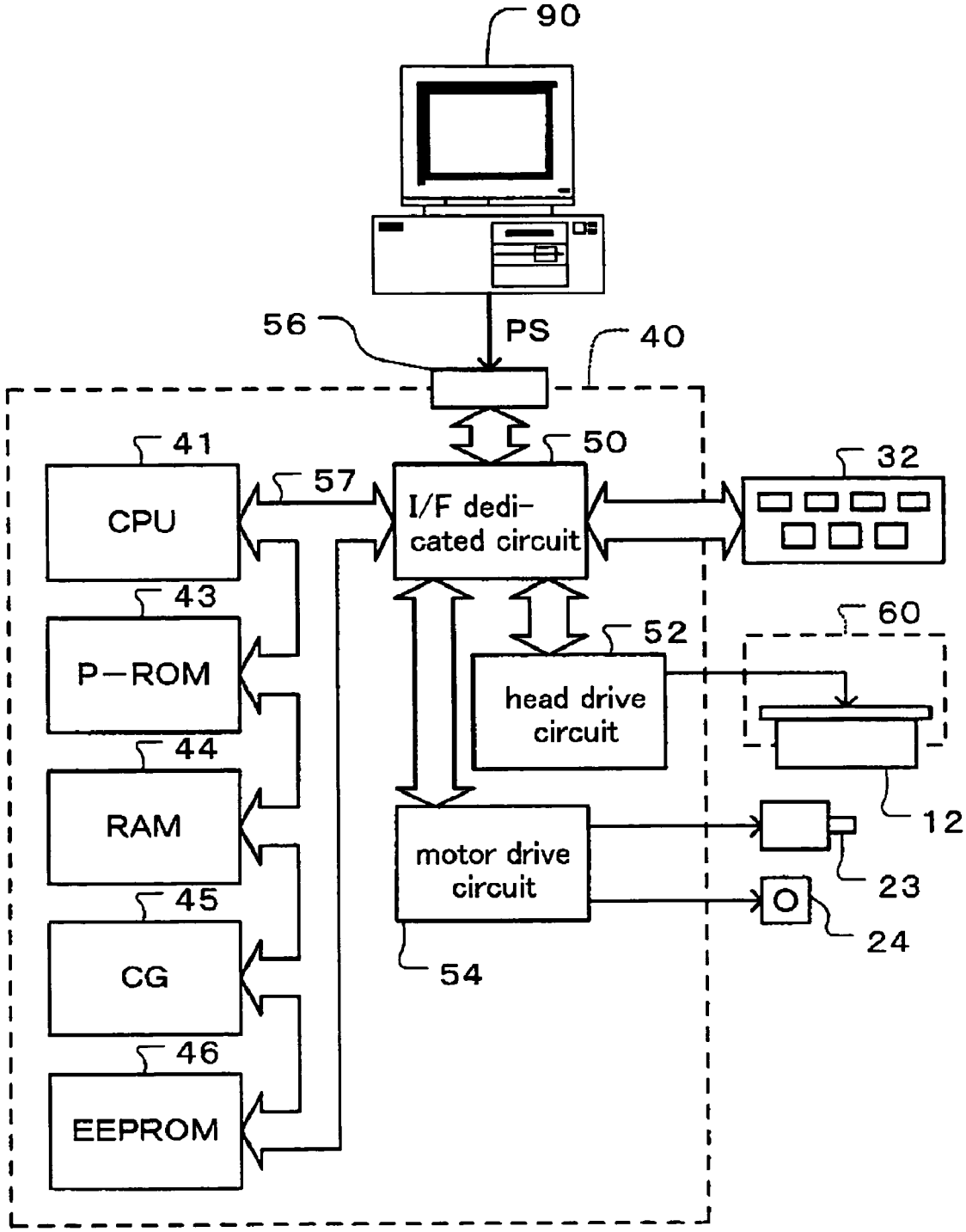
FIG. 2 is a block diagram showing a configuration of main components of a printer, centering on a control circuit, in the printing apparatus shown in FIG. 1.

As shown in FIG. 2, the control circuit 40 is configured as an arithmetic logic circuit having a CPU (Central Processing Unit) 41, a programmable ROM (P-ROM (Read Only Memory)) 43, a RAM (Random Access Memory) 44, a character generator (CG) 45 storing dot matrix information about characters (letters), and an EEPROM (Electronically Erasable and Programmable ROM) 46.

The control circuit 40 further includes: an I/F dedicated circuit 50 designed to serve as an interface (I/F) between, for example, external motors; a head drive circuit 52 that is connected to the I/F dedicated circuit 50 and that makes the print head unit 60 drive to eject ink; and a motor drive circuit 54 for driving the paper feed motor 23 and the carriage motor 24.

The I/F dedicated circuit 50 has inside a parallel interface circuit and is capable of receiving print signals PS supplied from the computer 90 via the connector 56.

<Configuration Example of Computer 90>

Next, the configuration of the computer 90 is described with reference to FIG. 3.

Figure 3:
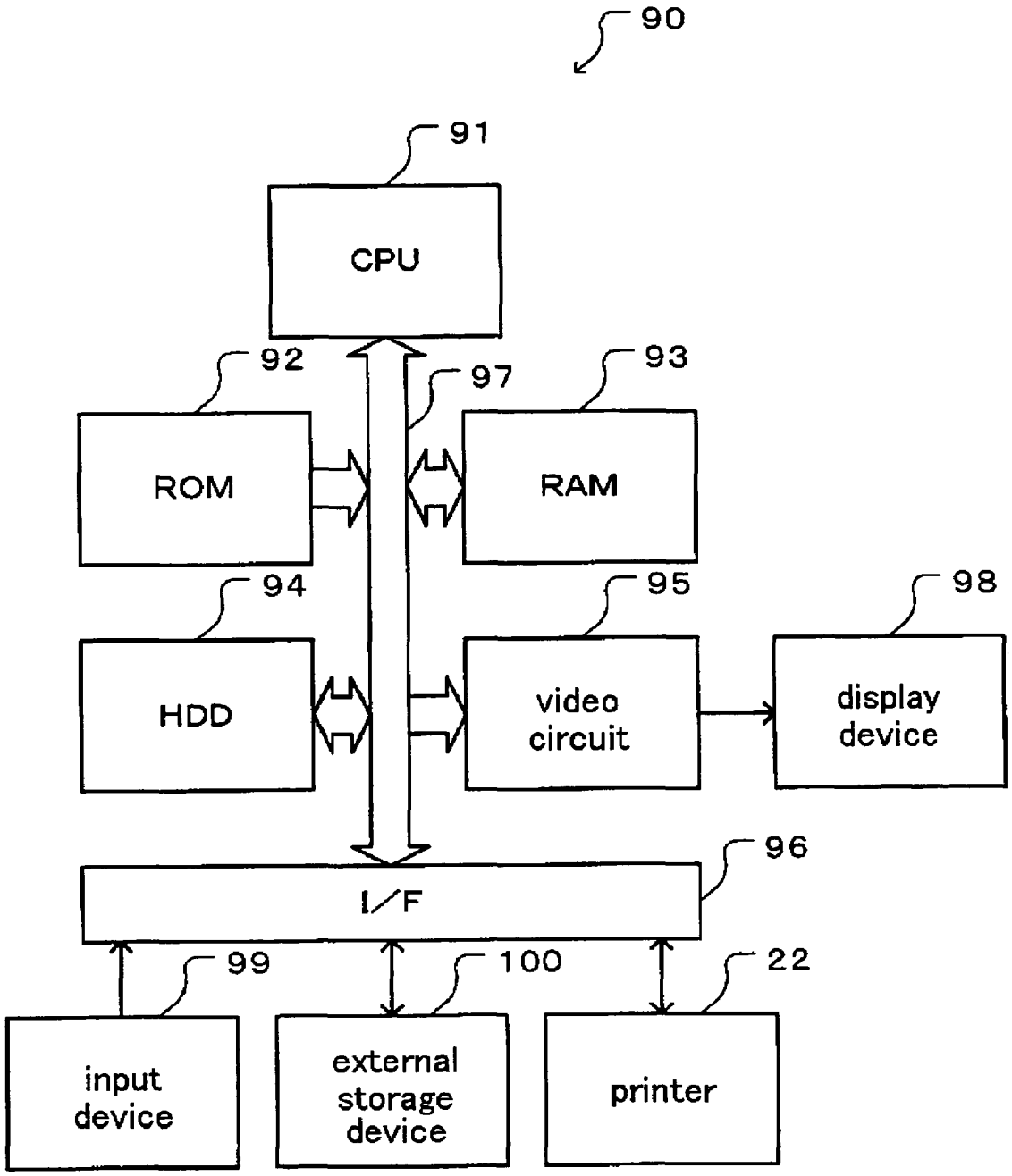
FIG. 3 is a block diagram showing a detailed configuration of a computer in the printing apparatus shown in FIG. 1.

As shown in FIG. 3, the computer 90 is structured of a CPU 91, a ROM 92, a RAM 93, a HDD (Hard Disk Drive) 94, a video circuit 95, an I/F 96, a bus 97, a display device 98, an input device 99, and an external storage device 100.

The CPU 91, which serves also as a first processing means and a second processing means, is a controller for executing various computing processes according to programs stored in the ROM 92 or the HDD 94, and for controlling the various sections of the apparatus.

The ROM 92 is a memory that stores basic programs and data that are executed by the CPU 91. The RAM 93, which serves as a storing means, is a memory that temporarily stores, for example, programs that are currently being executed by the CPU 91 and data that are being computed.

The HDD 94 is a recording device that reads out data and programs recorded on a hard disk, which is a storage medium, in response to requests from the CPU 91, and also records, onto the hard disk, data that have been generated as a result of the computing processes of the CPU 91.

The video circuit 95 is a circuit that executes drawing processes according to drawing commands that are supplied from the CPU 91, and that converts obtained image data into video signals to output them to the display device 98.

The I/F 96, which serves as a controller and a supplying means, is a circuit that appropriately converts the expression format of the signals that have been output from the input device 99 and the external storage device 100, and that outputs print signals PS to the printer 22.

The bus 97 is a signal line that mutually connects the CPU 91, the ROM 92, the RAM 93, the HDD 94, the video circuit 95, and the I/F 96, and that enables data exchange among these components.

The display device 98 is structured, for example, of an LCD (Liquid Crystal Display) monitor or a CRT (Cathode Ray Tube) monitor, and is for displaying images corresponding to the video signals having been output from the video circuit 95.

The input device 99 is structured, for example, of a keyboard and/or a mouse, and generates and supplies, to the I/F 96, signals in response to user operations.

The external storage device 100 is structured, for example, of a CD-ROM (Compact Disk-ROM) drive unit, an MO (Magneto Optic) drive unit, or an FDD (Flexible Disk Drive) unit, and reads out and supplies, to the CPU 91, data and programs recorded on a CD-ROM disk, an MO disk, or an FD. As for MO drive units and FDD units, the device 100 is also for recording the data supplied from the CPU 91 onto an MO disk or an FD.

Figure 4:
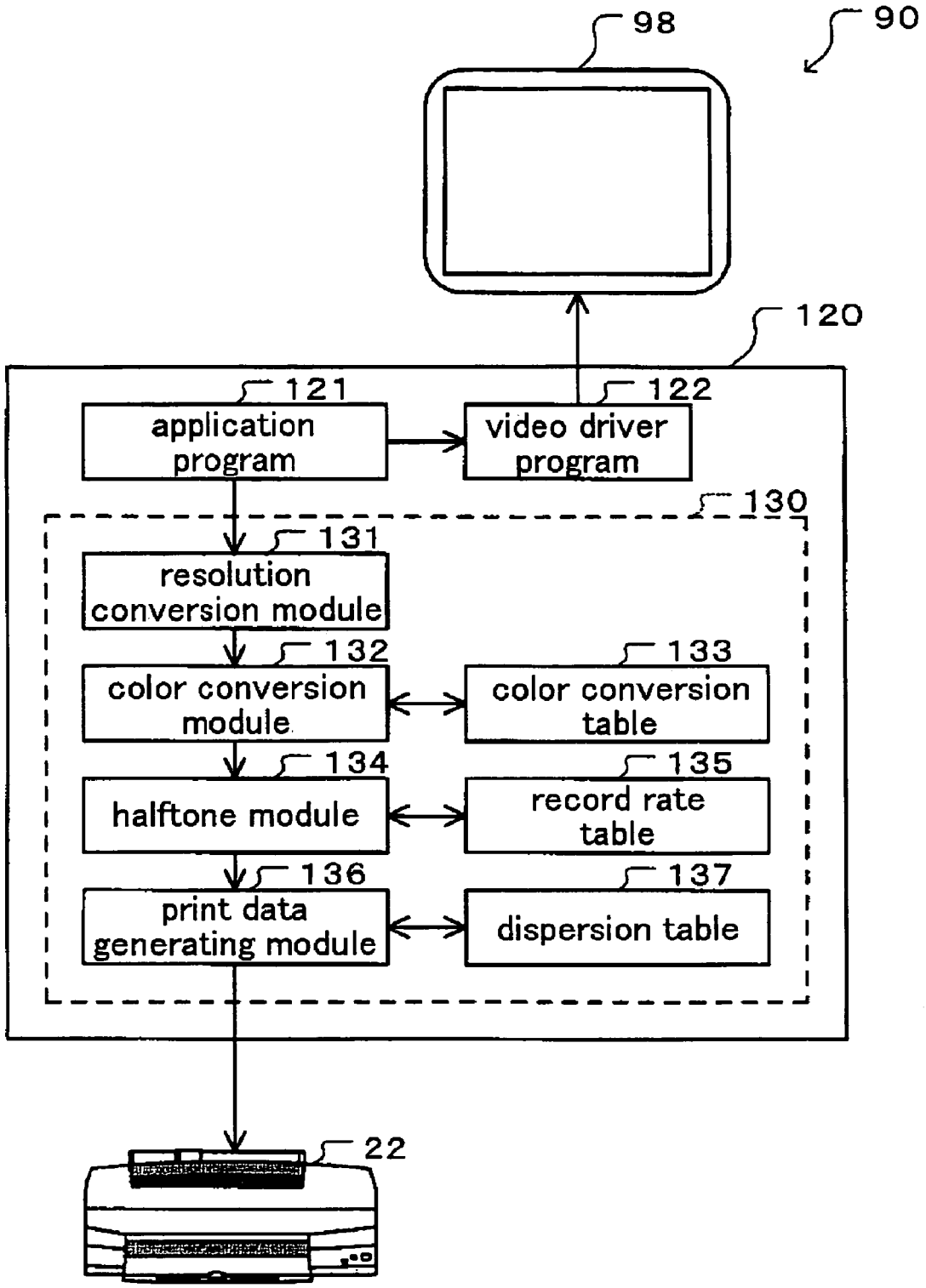
FIG. 4 is a diagram for illustrating details on various programs that are installed in the computer in the printing apparatus shown in FIG. 1.

FIG. 4 is a diagram for illustrating functions of the programs and drivers installed in the computer 90. It should be noted that these functions are achieved by cooperation of hardware of the computer 90 and software recorded on the HDD 94. As shown in FIG. 4, the computer 90 has installed an application program 121, a video driver program 122, and a printer driver program 130. These programs run under a predetermined operating system (OS).

The application program 121 is, for example, an image processing program, and is executed after an image taken in from a digital camera, for example, or an image drawn by a user has been processed and when the processed image is to be output to the printer driver program 130 and the video driver program 122.

The video driver program 122 is for driving the video circuit 95, and, for example, is executed after the image data supplied from the application program 121 has been subjected to gamma processing, white balance adjustment, or the like and when video signals are to be generated and supplied to the display device 98 for display.

The printer driver program 130 is made up of a resolution conversion module 131, a color conversion module 132, a color conversion table 133, a halftone module 134, a record rate table 135, a print data generating module 136, and a dispersion table 137. The printer driver program 130 is executed when print data are generated by subjecting the image data generated by the application program 121 to various kinds of processes described below, and the print data are supplied to the printer 22.

The resolution conversion module 131 is executed when a process is performed for converting the resolution of the image data supplied from the application program 121 according to the resolution of the print head 12.

The color conversion module 132 is executed when a process is performed for converting image data expressed in the RGB (Red, Green, and Blue) color system into image data expressed in the CMYK (Cyan, Magenta, Yellow, and Black) color system with reference to the color conversion table 133.

The halftone module 134 is executed when converting, according to dithering described later, the image data expressed in the CMYK color system into bitmap data made up of a combination of, for example, three types of dots—large, medium, and small—with reference to the record rate table 135.

The print data generating module 136, which serves as a controller, a portion of the first driving means, a portion of the second driving means, as well as a portion of the repeating means, is executed when generating, from the bitmap data output from the halftone module 134, print data that include raster data indicating the state in which dots are to be recorded during each main-scanning movement, and data indicating the feed amount of sub-scanning movement, and when supplying the print data to the printer 22.

The dispersion table 137 is a table that is referred to when the raster data, which indicate the state in which dots are to be recorded during each main-scanning movement, are generated from the bitmap data, which have been output from the halftone module 134, and includes dispersion data for dispersedly printing the dots.

The print data, which have been generated by executing the print data generating module 136, are supplied to the printer 22, and dots that correspond to the print data are formed on the print paper P.

<First Embodiment of Dot Formation Process>

Next, a flow of a process according to the first embodiment through which dots are formed is described with reference to FIG. 5. This process is executed by the computer 90. When this flow is started, the steps described below are executed.

Step S110:

The printer driver program 130 receives, from the application program 121, image data expressed in the RGB color system. It should be noted that the image data have gray-level values in 256 levels, i.e., made up of values 0 through 255, for each color of R, G, and B and for each pixel. Image data having gray-level values in 64 levels (values 0 through 63) or 32 levels (values 0 through 31) may be adopted, but in this embodiment, data with gray-level values in 256 levels as described above are used for explanation.

Step S111:

The resolution conversion module 131 converts the resolution of the image data, which have been input, into the resolution of the printer 22 (which is referred to as "print resolution" below). If the resolution of the image data is lower than the print resolution, then resolution conversion is performed by generating new data between adjacent ones of original image data through linear interpolation etc. On the contrary, if the resolution of the image data is higher than the print resolution, then resolution conversion is performed, for example, by thinning out the image data at a predetermined rate.

Step S112:

The color conversion module 132 performs a color conversion process. The color conversion process is a process for converting the image data that have gray-level values for each R, G, and B into multi-level data expressing gray-level values for each color of C, M, Y, and K that are used in the printer 22. This process is performed using the color conversion table 133 in which the colors made up by combinations of R, G, and B are recorded in association with combinations of C, M, Y, and K so that they can be expressed using the printer 22.

Step S113:

The halftone module 134 performs a halftone process with respect to the image data that have been subjected to color conversion at step S112. The halftone process is a process for performing a decrease in color, i.e., for changing the gray-level values of the original image data (256 levels in the present embodiment) to gray level values that can be expressed, for each pixel, by the printer 22. The term "decrease in color" means to decrease the number of levels in gray for expressing each color. It should be noted that more specifically, a decrease in color to four levels—"no dot formed", "form small dot", "form middle-size dot", and "form large dot"—is performed, for example.

Step S114:

The print data generating module 136 performs a process for generating print data from the bitmap data generated through the halftone process. Print data include raster data indicating the state in which dots are to be recorded during each main-scanning movement, and data indicating the feed amount of sub-scanning movement. It should be noted that a dot dispersion process is executed when the print data are generated, but details on the dispersion process will be described further below with reference to FIG. 6.

Step S115:

The print data generating module 136 outputs, to the printer 22, the print data that have been generated through the print data generating process at step S114. Then the process is ended.

Figure 5:
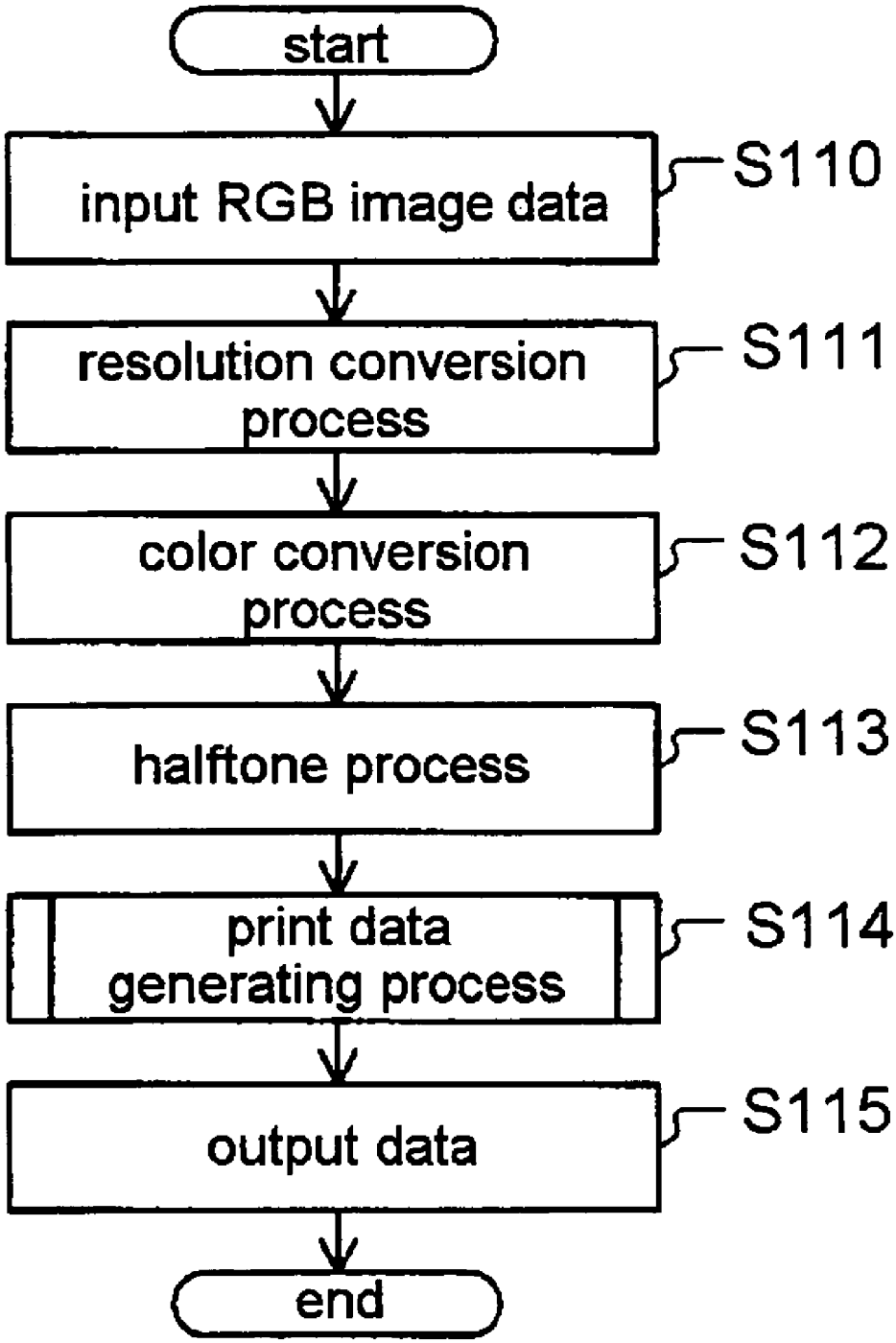
FIG. 5 is a flowchart for illustrating a flow of a process executed by a printer driver program that is installed in the computer in the printing apparatus shown in FIG. 1.
Figure 6:
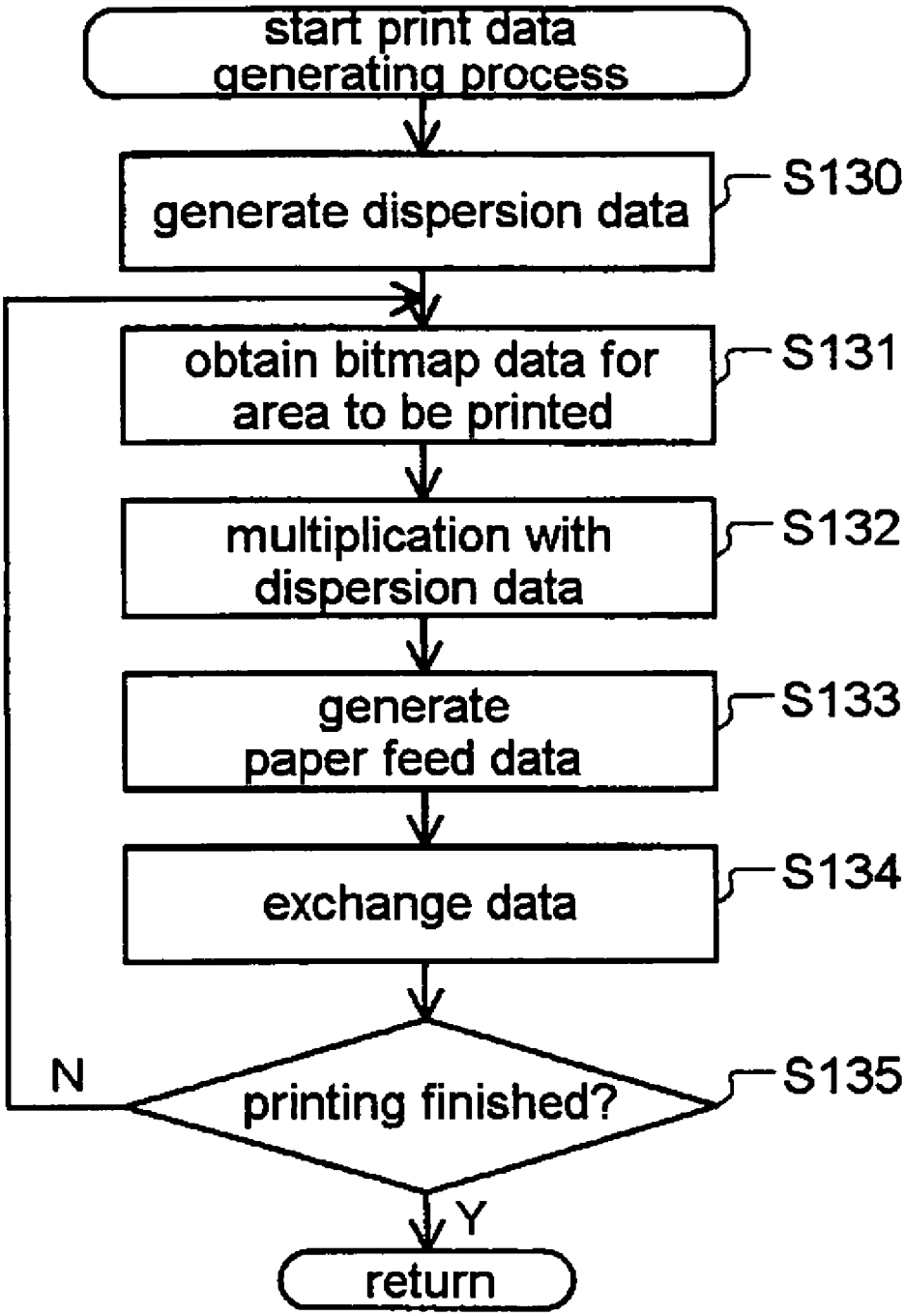
FIG. 6 is a flowchart for illustrating a detailed flow of a print data generating process shown in the flowchart of FIG. 5.

Next, the print data generating process, which is step S114 in the flowchart shown in FIG. 5, is described in detail. FIG. 6 is a flowchart for illustrating the details on the print data generating process. When this flow is started, the steps described below are executed.

Step S130:

The print data generating module 136 generates dispersion data for dispersing the dots, and stores the dispersion data into the dispersion table 137.

FIG. 7 shows a diagram illustrating an example of the dispersion data. In this example, the dispersion data is made up of data that have 4×10 bits in the vertical and lateral directions, respectively, and that correspond to nozzles N1 through N4 formed in the print head 12 and serving as dot forming elements. Each bit is generated using, for example, random numbers such that the printed dot pattern becomes aperiodic, i.e., irregular. In this example, row data 137*a* corresponding to the nozzle N1 is "1011001001", and this is a complement (i.e., data in which all bits are inverted) of "0100110110", which is row data 137*c* corresponding to the nozzle N3. Further, row data 137*b* corresponding to the nozzle N2 is "0110011100", and this is a complement (i.e., data in which all bits are inverted) of "1001100011", which is row data 137*d* corresponding to the nozzle N4.

It should be noted that "aperiodic" refers to cases other than the case in which "1" appears at constant intervals (such as at every other bit), for example.

The method for generating the dispersion data may be as follows. For example, when the row data 137*a* is to be generated, data "0000000000" is first prepared as original data. Then, a random number within the range of 1 through 10 is generated, and the bit corresponding to the random number obtained is changed to "1". The same process is repeated until five bits are changed to "1". The data thus obtained is taken as the row data 137*a*, and data obtained by inverting the row data 137*a* is taken as the row data 137*c*. The same process can be used to obtain the row data 137*b* and 137*d*.

It should be noted that in the example shown in FIG. 7, each row data is set such that five bits are changed to "1". This, however, is not a restriction, and it is possible to generate the dispersion data using random numbers on a bit-by-bit basis. For example, it is possible to obtain the dispersion data by generating a random number within a range of 0 through 1, setting a corresponding bit to "1" if the random number is 0.5 or larger but setting the bit to "0" if the number is less than 0.5, and performing such processes for all of the bits. Further, data for a certain row does not have to be generated by inverting data of another row, and it is possible to generate data for all rows by generating random numbers for each of them.

Step S131:

The print data generating module 136 obtains bitmap data for each color that correspond to the area to be printed. That is, the module obtains, from the halftone module 134, the bitmap data for each color that correspond to the area that is to be printed next with one scanning movement.

Step S132:

The print data generating module 136 obtains raster data by multiplying, to each bit in the bitmap data obtained for each color, a corresponding bit in the dispersion data, which is stored in the dispersion table 137. It should be noted that if the size of the bitmap data is larger than the dispersion data, then the bitmap data may be divided into several areas each corresponding to the size of the dispersion data, and the dispersion data may be multiplied to each of those areas.

Step S133:

The halftone module 134 generates paper feed data. For example, the paper feed data (i.e., the sub-scanning pitch L) is set such that it becomes 3/2 times the nozzle pitch k for an odd-numbered sub-scanning movement, as described below. Further, the paper feed data is set such that it becomes half the nozzle pitch k for an even-numbered sub-scanning movement.

Step S134:

The halftone module 134 supplies, to the printer 22, the print data including the raster data generated at step S132 and the paper feed data generated at step S133.

Step S135:

The halftone module 134 determines whether or not printing has finished. If it is determined that printing is not finished, then the process returns to step S131 and the same processes are repeated, and in other cases, the process is ended.

Next, the operations of the printer 22 that has received the print data, which have been generated according to the processes described above, is described with reference to FIG. 8 through FIG. 12.

Figure 8:
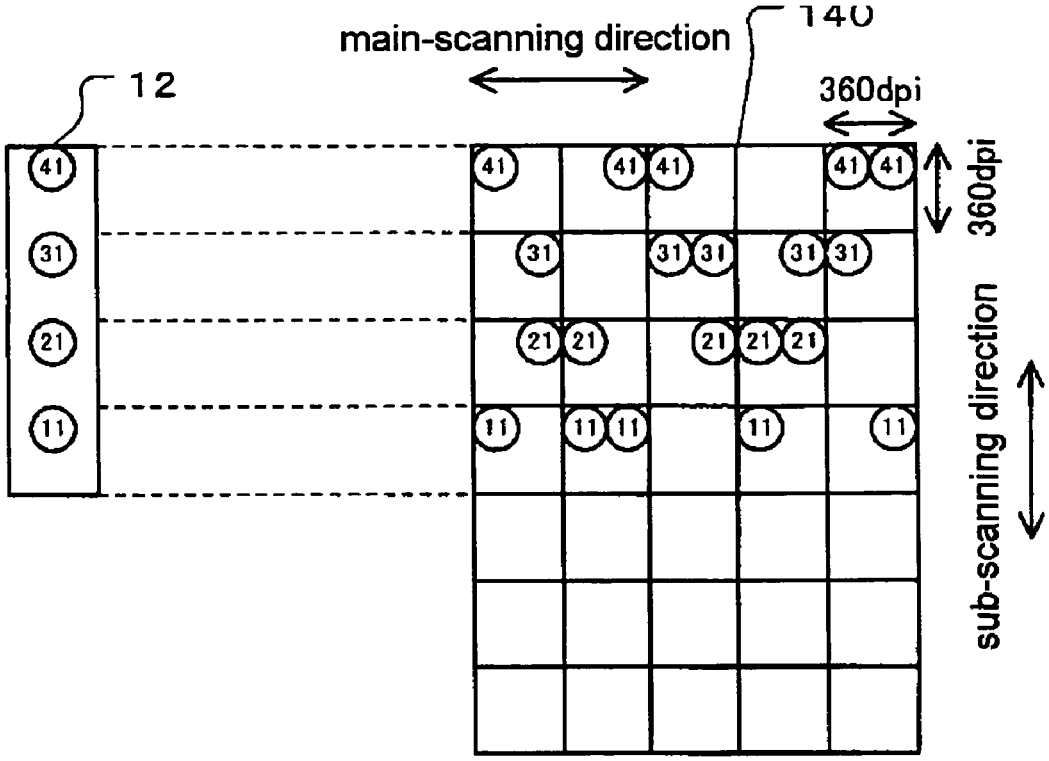
FIG. 8 is a diagram for illustrating an operation for a case in which k=2, s=2, and the number of nozzles N of the print head shown in FIG. 1 is 4, and shows a state in which dots are printed during a first scanning movement.

FIG. 8 is a diagram showing a state in which dots are printed in the first scanning movement. As shown in FIG. 8, in the first scanning movement, the print head 12 performs a scanning movement such that its nozzles N1 through N4 move along the upper end section of each of the outer borders 140 arranged in a matrix, and dots are formed, with respect to the upper section in each outer border, at positions that correspond to sections where the bit in the dispersion data shown in FIG. 7 is "1", whereas no dot is formed at positions that correspond to sections where the bit is "0".

Figure 9:
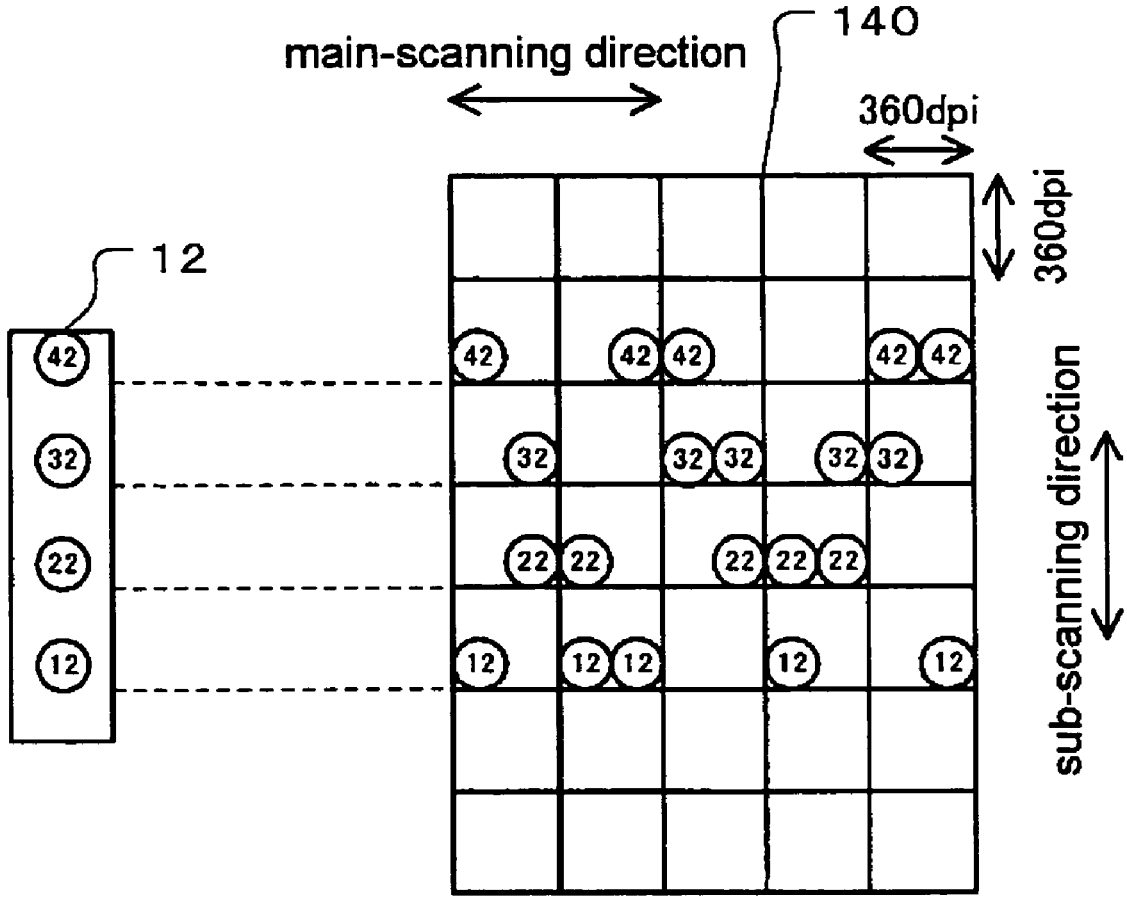
FIG. 9 is a diagram for illustrating an operation for a case in which k=2, s=2, and the number of nozzles N of the print head shown in FIG. 1 is 4, and shows a state in which dots are printed during a second scanning movement.

FIG. 9 is a diagram showing a state in which dots are printed in the second scanning movement. As shown in FIG. 9, in the second scanning movement, a sub-scanning movement for a distance corresponding to 3/2 times the nozzle pitch k is carried out, and then, dots are formed, with respect to the lower section in each outer border, at positions that correspond to sections where the bit in the dispersion data shown in FIG. 7 is "1", whereas no dot is formed at positions that correspond to sections where the bit is "0".

Figure 10:
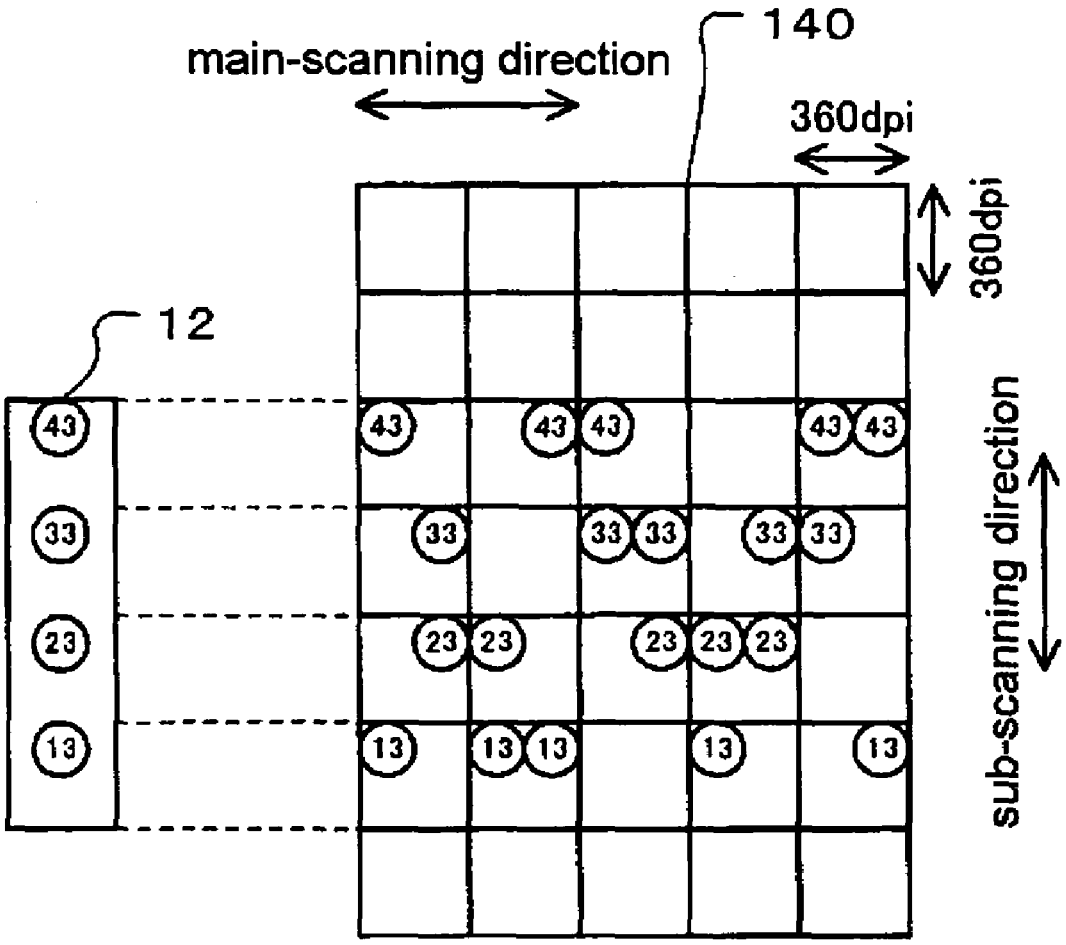
FIG. 10 is a diagram for illustrating an operation for a case in which k=2, s=2, and the number of nozzles N of the print head shown in FIG. 1 is 4, and shows a state in which dots are printed during a third scanning movement.

FIG. 10 shows a diagram for illustrating a state in which dots are printed in the third scanning movement. As shown in FIG. 10, in the third scanning movement, a sub-scanning movement for a distance corresponding to 1/2 times the nozzle pitch k is carried out, and then, dots are formed, with respect to the upper section in each outer border, at positions that correspond to sections where the bit in the dispersion data shown in FIG. 7 is "1", whereas no dot is formed at positions that correspond to sections where the bit is "0".

Figure 11:
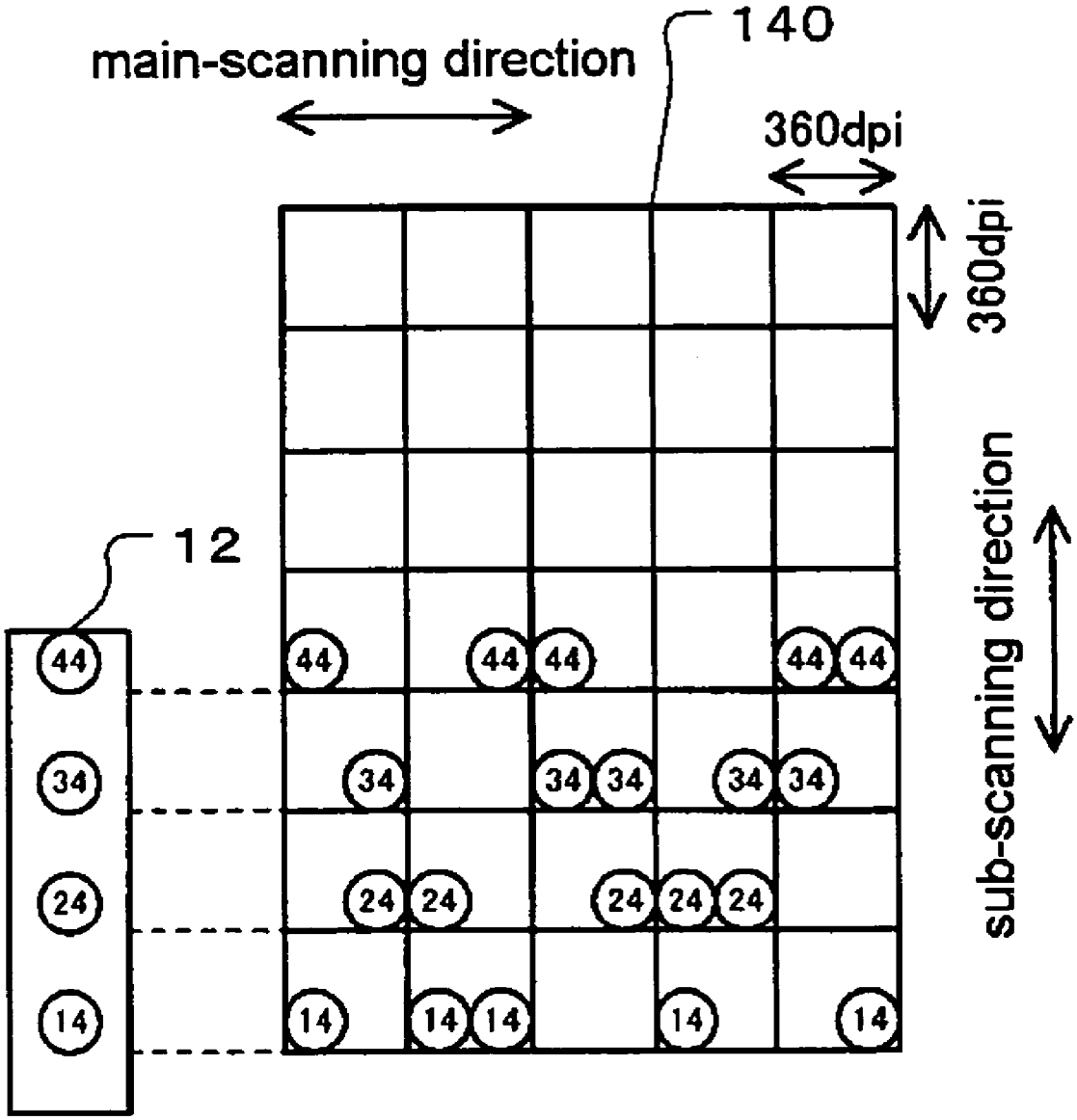
FIG. 11 is a diagram for illustrating an operation for a case in which k=2, s=2, and the number of nozzles N of the print head shown in FIG. 1 is 4, and shows a state in which dots are printed during a fourth scanning movement.

FIG. 11 shows a diagram for illustrating a state in which dots are printed in the fourth scanning movement. As shown in FIG. 11, in the fourth scanning movement, a sub-scanning movement for a distance corresponding to 3/2 times the nozzle pitch k is carried out, and then, dots are formed, with respect to the lower section in each outer border, at positions that correspond to sections where the bit in the dispersion data shown in FIG. 7 is "1", whereas no dot is formed at positions that correspond to sections where the bit is "0".

The same processes are repeated for each color, and a desired image is printed on the print paper P by repeating these processes over the entire image.

Figure 12:
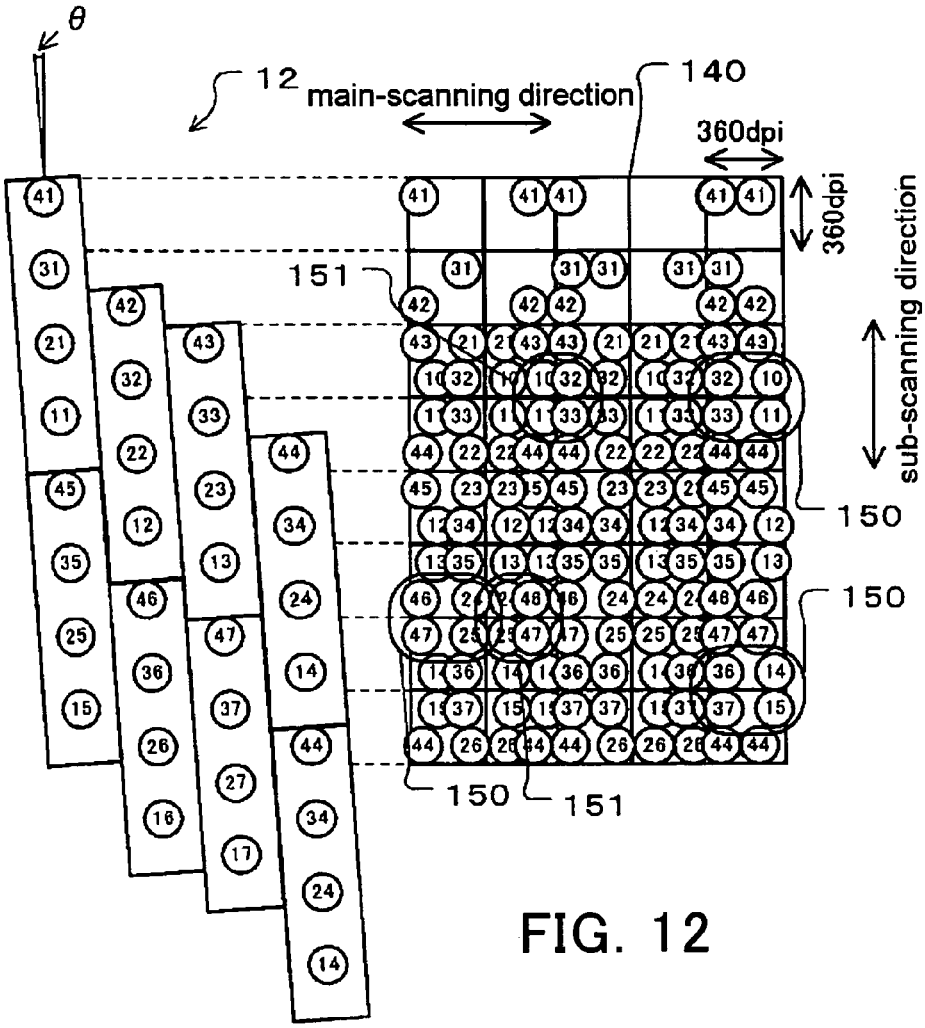
FIG. 12 is a diagram for illustrating an operation for a case in which k=2, s=2, and the number of nozzles N of the print head shown in FIG. 1 is 4, and shows a state in which dots are printed during the first through eighth scanning movements.
Figure 33:
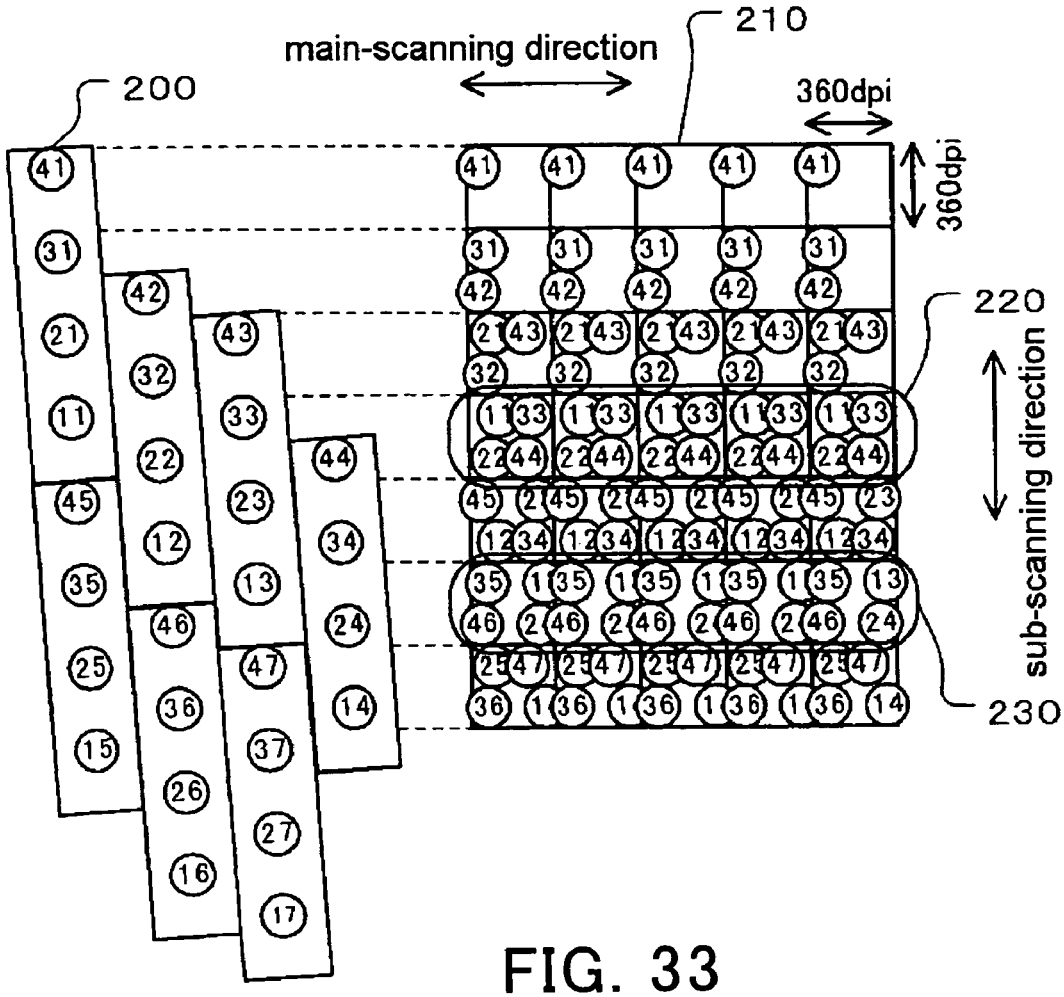
FIG. 33 is a diagram showing a state in which banding has occurred, and shows a situation in which banding has occurred when the print head is tilted by the angle θ.

FIG. 12 is a diagram showing a state in which dots are formed when the print head 12 is tilted at an angle θ. As shown in FIG. 12, according to the present embodiment, even when the print head 12 is tilted by the angle θ, the sections 150 in which the dots are sparsely scattered and the sections 151 in which the dots are densely gathered are randomly dispersed. Therefore, it is possible to prevent occurrence of banding, which is caused by the dense sections and/or the sparse sections gathering on the same scan line, as is the case with the conventional art shown in FIG. 33.

Further, according to the foregoing embodiment, since the sections 150 in which the dots are sparsely scattered and the sections 151 in which the dots are densely gathered are randomly dispersed, the sharpness of an image can be reduced, thereby allowing obtainment of a soft-touch image. That is, the pixels (dots) are suitably dispersed as with silver halide photography, and therefore, it is possible to obtain an image that looks natural.

It should be noted that in the foregoing embodiment, an example was described in which the nozzle pitch k of the print head 12 is "2". The present invention, however, is applicable to other situations.

FIG. 13 through FIG. 16 are diagrams showing another embodiment using a print head 12A in which the nozzle pitch k is "1".

Figure 13:
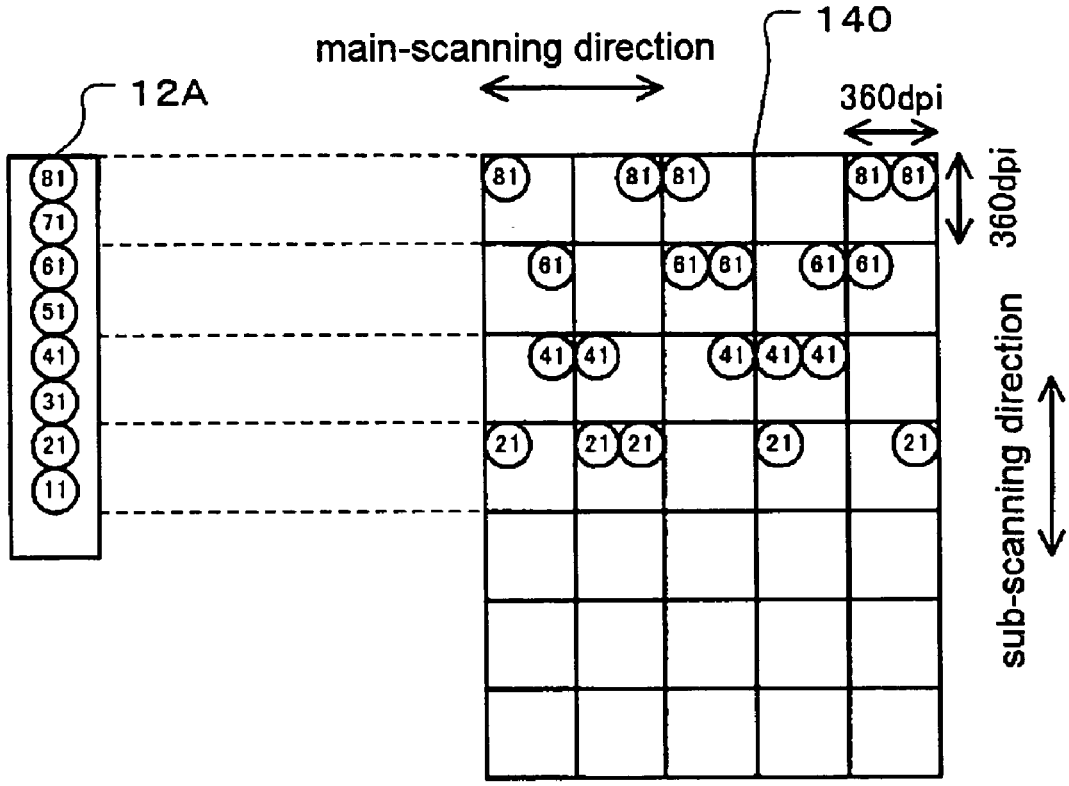
FIG. 13 is a diagram for illustrating an operation for a case in which k=1, s=2, and the number of nozzles N of the print head shown in FIG. 1 is 8, and shows a state in which dots are printed during a first scanning movement.

FIG. 13 is a diagram for illustrating the first scanning movement of the print head 12A in which the nozzle pitch k is "1". In the embodiment of FIG. 13, the first through eighth nozzles are arranged densely together, and the interval between the centers of two nozzles is set such that it amounts to a single pitch of a printed image (i.e., one dot pitch w).

As shown in FIG. 13, in the first scanning movement, a printing operation is carried out by the even-numbered nozzles (i.e., the second, fourth, sixth, and eighth nozzles) with respect to the upper section in each outer border such that dots are formed at positions that correspond to sections having "1" in the dispersion data shown in FIG. 7, whereas no dot is formed at positions that correspond to sections where the bit is "0".

Figure 14:
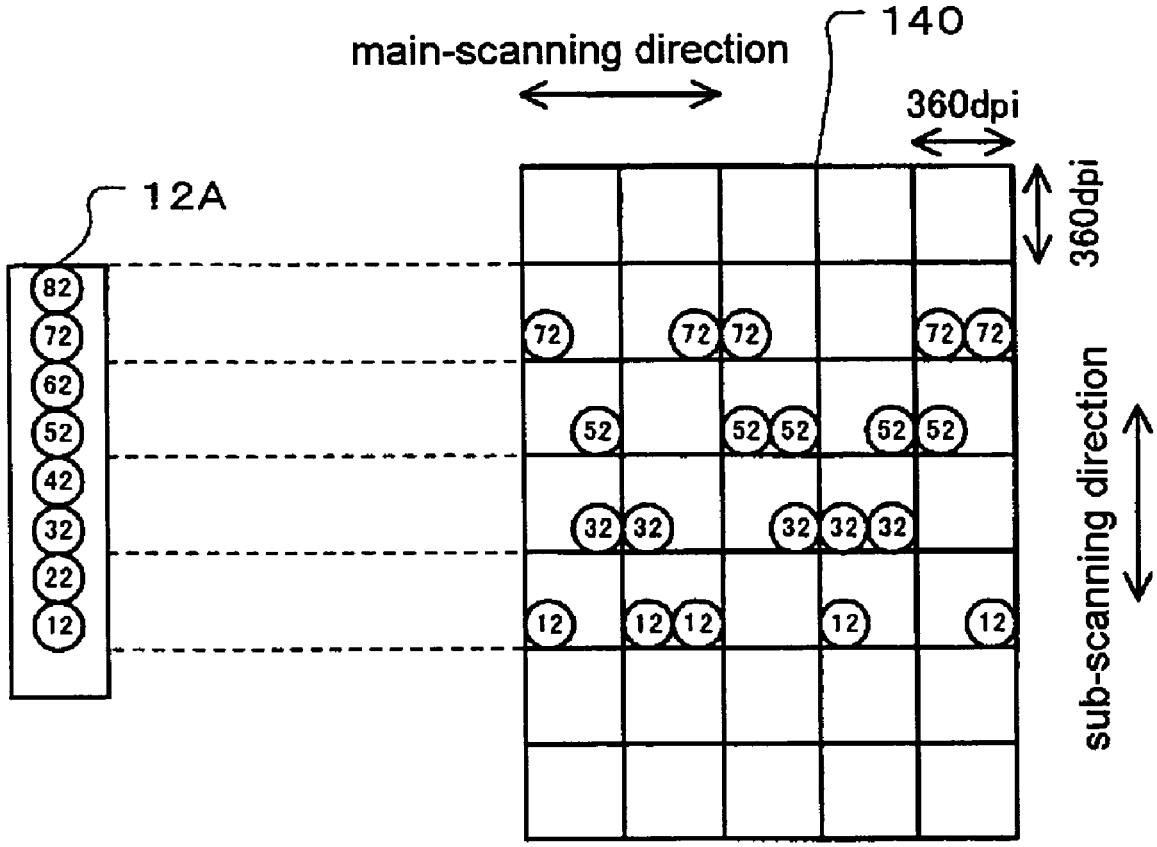
FIG. 14 is a diagram for illustrating an operation for a case in which k=1, s=2, and the number of nozzles N of the print head shown in FIG. 1 is 8, and shows a state in which dots are printed during a second scanning movement.

Next, as shown in FIG. 14, a sub-scanning movement for a distance amounting to twice the nozzle pitch k is carried out, and then, a printing operation is carried out by the odd-numbered nozzles (i.e., the first, third, fifth, and seventh nozzles) with respect to the lower section in each outer border such that dots are formed at sections that correspond to "1" in the dispersion data shown in FIG. 7, whereas no dot is formed at sections that correspond to "0".

Figure 15:
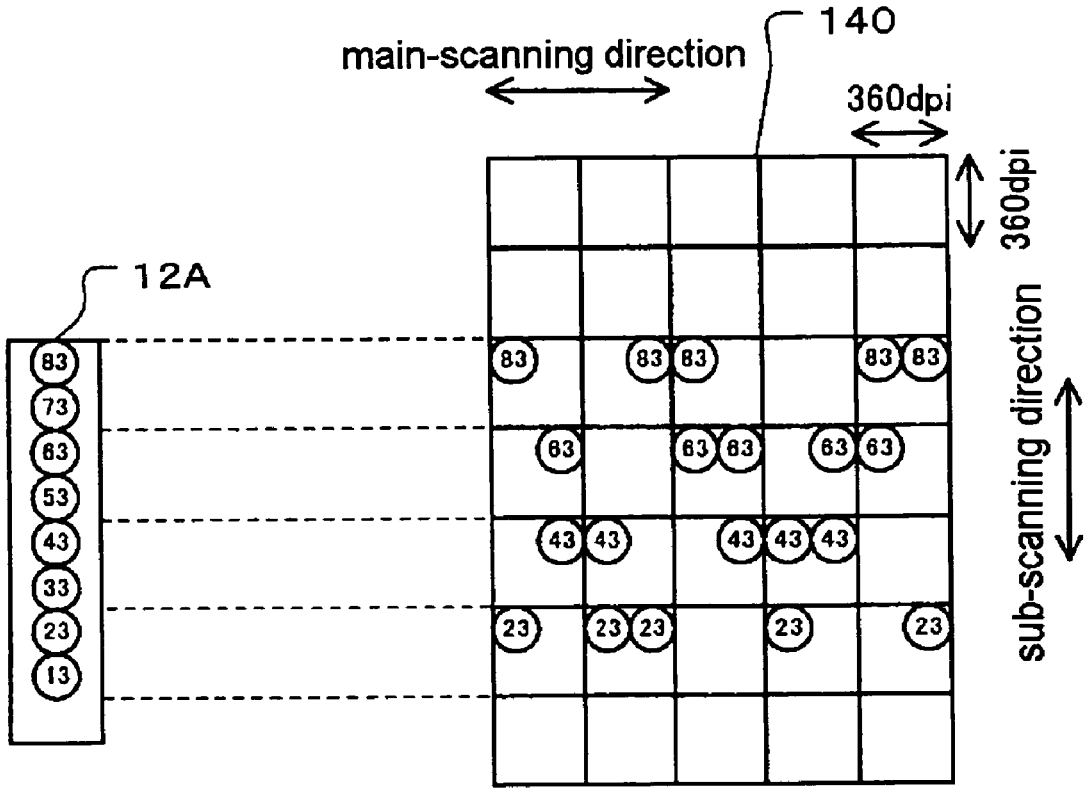
FIG. 15 is a diagram for illustrating an operation for a case in which k=1, s=2, and the number of nozzles N of the print head shown in FIG. 1 is 8, and shows a state in which dots are printed during a third scanning movement.

Then, as shown in FIG. 15, a sub-scanning movement for a distance amounting to twice the nozzle pitch k is carried out, and then, a printing operation is carried out by the even-numbered nozzles with respect to the upper section in each outer border such that dots are formed at sections that correspond to "1" in the dispersion data shown in FIG. 7, whereas no dot is formed at sections that correspond to "0".

Figure 16:
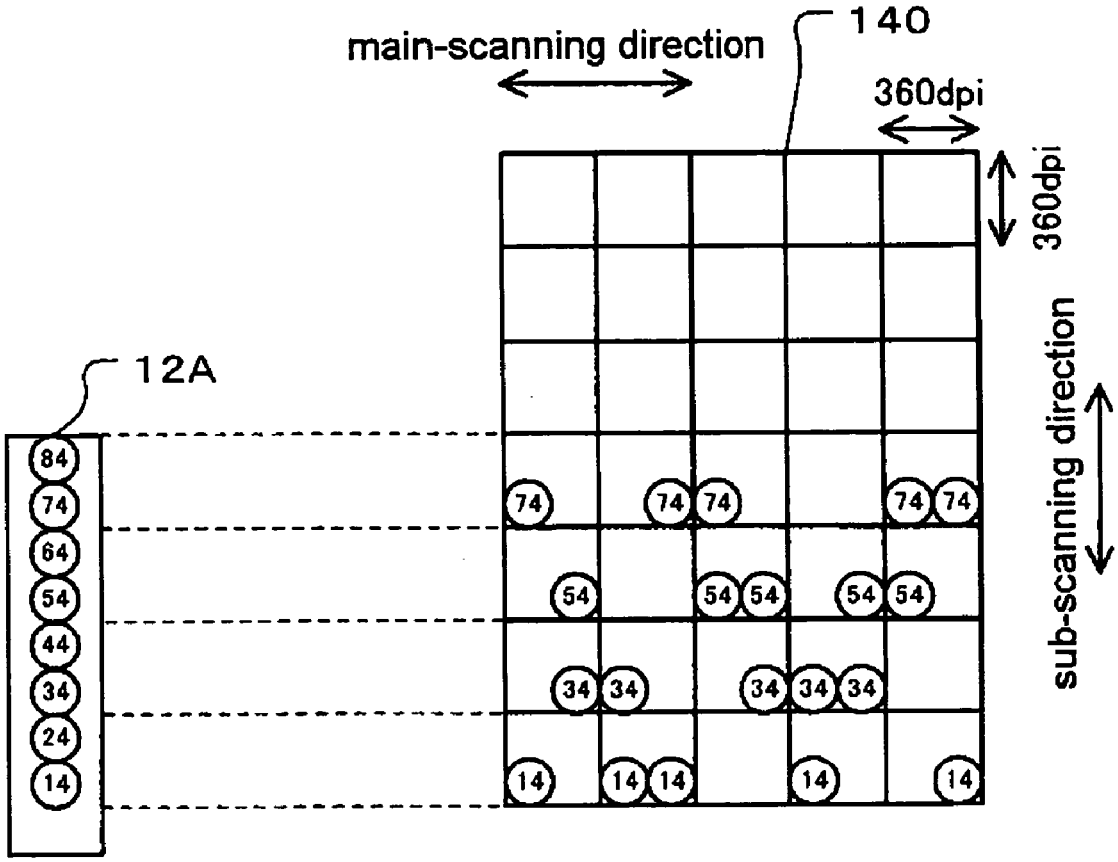
FIG. 16 is a diagram for illustrating an operation for a case in which k=1, s=2, and the number of nozzles N of the print head shown in FIG. 1 is 8, and shows a state in which dots are printed during a fourth scanning movement.

Next, as shown in FIG. 16, a sub-scanning movement for a distance amounting to twice the nozzle pitch k is carried out, and then, a printing operation is carried out by the odd-numbered nozzles with respect to the lower section in each outer border, which is arranged in a matrix, such that dots are formed at sections that correspond to "1" in the dispersion data shown in FIG. 7, whereas no dot is formed at sections that correspond to "0".

Figure 17:
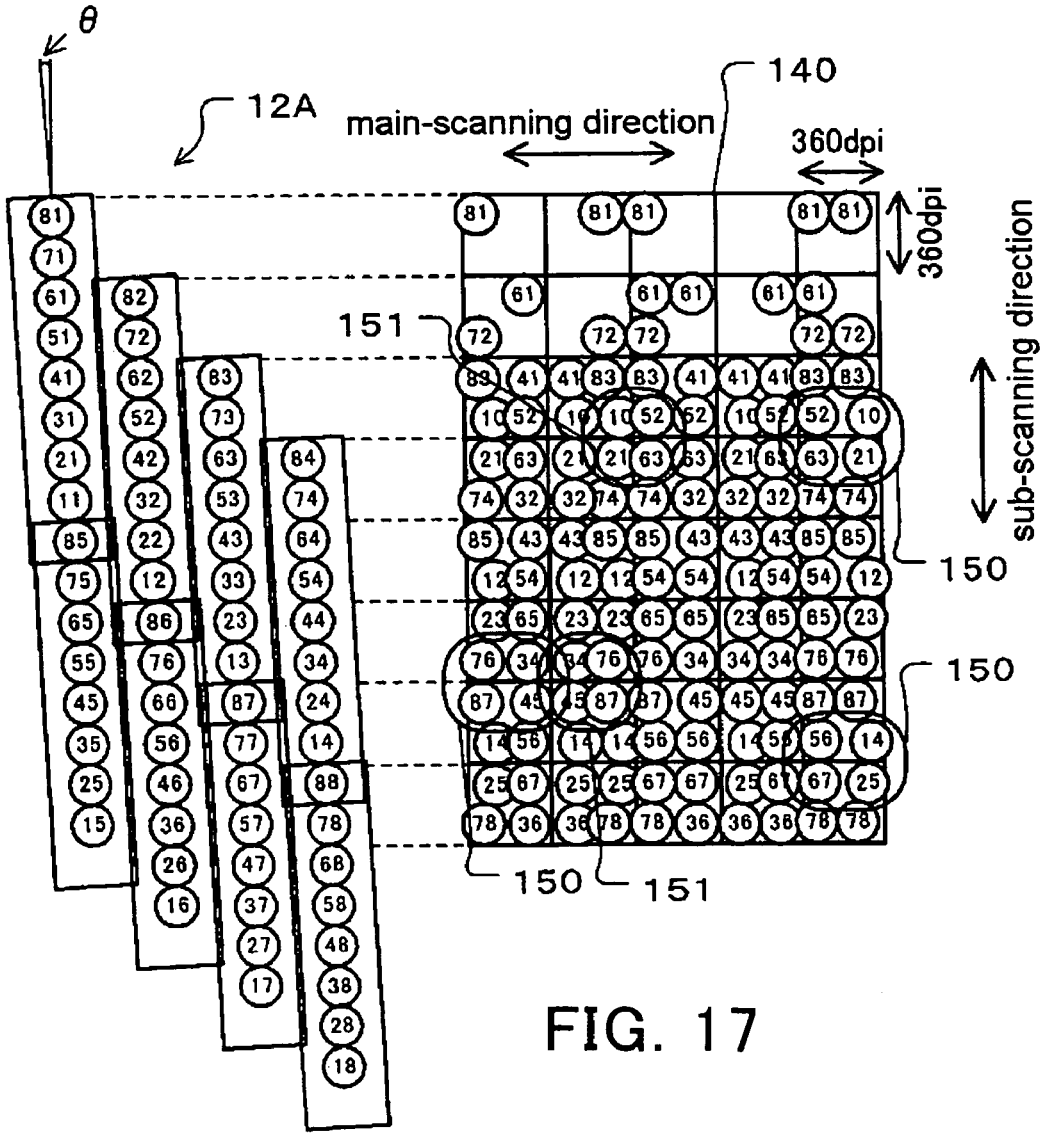
FIG. 17 is a diagram for illustrating an operation for a case in which k=1, s=2, and the number of nozzles N of the print head shown in FIG. 1 is 8, and shows a state in which dots are printed during the first through eighth scanning movements.

FIG. 17 is a diagram showing a state in which the dots printed in the first through eighth scanning movements have been superposed. As shown in FIG. 17, the dots arranged on each scan line do not have periodicity in which dots that are formed by the same nozzle appear in the same order, and thus, the dots are suitably dispersed. Therefore, the sections in which the dots are sparse and the sections in which the dots are dense are printed dispersedly.

As described above, according to another embodiment of the present invention, the dots are randomly dispersed in the print data generating module 136 using the dispersion table 137. Therefore, it is possible to prevent occurrence of banding, which is caused by the dot-sparse sections 150 and the dot-dense sections 151 gathering on the same scan line.

Further, as with the foregoing embodiment, in this embodiment, since the sections 150 in which the dots are sparsely scattered and the sections 151 in which the dots are densely gathered are randomly dispersed, the sharpness of an image can be reduced, thereby allowing obtainment of a soft-touch image. That is, the pixels (dots) are suitably dispersed as with silver halide photography, and therefore, it is possible to obtain an image that looks natural.

Some embodiments of the present invention were described above, but the present invention can be modified in various ways. For example, the embodiment shown in FIG. 8 through FIG. 12 was described using an example in which the number of nozzles is N=4, the inter-nozzle pitch is k=2, and the number of times scanning is repeated is s=2, and the embodiment shown in FIG. 13 through FIG. 17 was described using an example in which the number of nozzles is N=8, the inter-nozzle pitch is k=1, and the number of times scanning is repeated is s=2. It is of course possible to apply the present invention to other situations.

Further, the foregoing embodiments were described using an example in which there is only one print head 12. It is possible, however, to arrange two or more print heads in the sub-scanning direction in such a manner that they do not interfere with each other and to print different scan lines with those print heads. For example, as for the examples shown in FIG. 8 through FIG. 12 or FIG. 13 through FIG. 17, the dots corresponding to the even-numbered nozzles may be printed with a first print head, and the dots corresponding to the odd-numbered nozzles may be printed with a second print head. With such an embodiment, it becomes possible to increase printing speed.

Further, in the foregoing embodiments, the dispersion data were generated, at step S130 shown in FIG. 6, every time a printing process is executed. It is possible, however, to generate the dispersion data and store the data in the HDD 94 in advance, and use these data. With such a process, it becomes possible to increase processing speed because it is not necessary to generate the dispersion data every time printing is carried out.

Further, in the foregoing embodiments, the same dispersion table was used for all of the colors. It is possible, however, to use dispersion tables having different patterns for each color, or to divide the colors into several groups and share the same dispersion table in each group. When dispersion tables having different patterns for each color are used, the dot-dispersion patterns will differ for each color. Thus, it becomes possible to prevent occurrence of banding even certainly by dispersing the dot-dense sections and the dot-sparse sections per each color.

Further, in the foregoing embodiments, four colors of ink in CMYK were used. It is possible, however, to use light colored inks (such as light cyan (LC) ink, light magenta (LM) ink, and dark yellow (DY) ink) in addition to, or instead of, the above-mentioned four colors of ink.

Further, in the foregoing embodiments, a printer 22 provided with a head that ejects ink using piezoelectric elements was used. It is possible, however, to use various elements other than the piezoelectric element as the ejection-drive elements. For example, the present invention is applicable to printers provided with ejection-drive elements of the type in which a current is passed through a heater arranged in the ink passage and ink is ejected using bubbles that are created inside the ink passage.

<Second Embodiment of Dot Formation Process>

Next, a flow of a process according to the second embodiment through which dots are formed is described with reference to FIG. 18. This process is executed by the computer 90. When this flow is started, the steps described below are executed.

Step S210:

In accordance with the printer driver program 130, the CPU 91 receives, from the application program 121, image data expressed in the RGB color system. It should be noted that the image data have gray-level values in 256 levels, i.e., made up of values 0 through 255, for each color of R, G, and B and for each pixel. Image data having gray-level values in 64 levels (values 0 through 63) or 32 levels (values 0 through 31) may be adopted, but in this embodiment, data with gray-level values in 256 levels as described above are used for explanation.

Step S211:

In accordance with the resolution conversion module 131, the CPU 91 converts the resolution of the image data, which have been input, into the resolution of the printer 22 (which is referred to as "print resolution" below). If the resolution of the image data is lower than the print resolution, then resolution conversion is performed by generating new data between adjacent ones of original image data through linear interpolation etc. On the contrary, if the resolution of the image data is higher than the print resolution, then resolution conversion is performed, for example, by thinning out the image data at a predetermined rate.

Step S212:

In accordance with the color conversion module 132, the CPU 91 performs a color conversion process. The color conversion process is a process for converting the image data that have gray-level values for each R, G, and B into multi-level data expressing gray-level values for each color of C, M, Y, and K that are used in the printer 22. This process is performed using the color conversion table 133 in which the colors made up by combinations of R, G, and B are recorded in association with combinations of C, M, Y, and K so that they can be expressed using the printer 22.

Step S213:

In accordance with the halftone module 134, the CPU 91 performs a halftone process with respect to the image data that have been subjected to color conversion at step S212. The halftone process is a process for performing a decrease in color, i.e., for changing the gray-level values of the original image data (256 levels in the present embodiment) to gray level values that can be expressed, for each pixel, by the printer 22. The term "decrease in color" means to decrease the number of levels in gray for expressing each color. It should be noted that more specifically, a decrease in color to four levels—"no dot formed", "form small dot", "form middle-size dot", and "form large dot"—is performed, for example.

Step S214:

In accordance with the print data generating module 136, the CPU 91 performs a process for generating print data from the bitmap data generated through the halftone process. Print data include raster data indicating the state in which dots are to be recorded during each main-scanning movement, and data indicating the feed amount of sub-scanning movement. It should be noted that a dot dispersion process is executed when the print data are generated, but details on the dispersion process will be described further below with reference to FIG. 19.

Step S215:

In accordance with the print data generating module 136, the CPU 91 outputs, to the printer 22, the print data that have been generated through the print data generating process at step S214. Then the process is ended.

Figure 18:
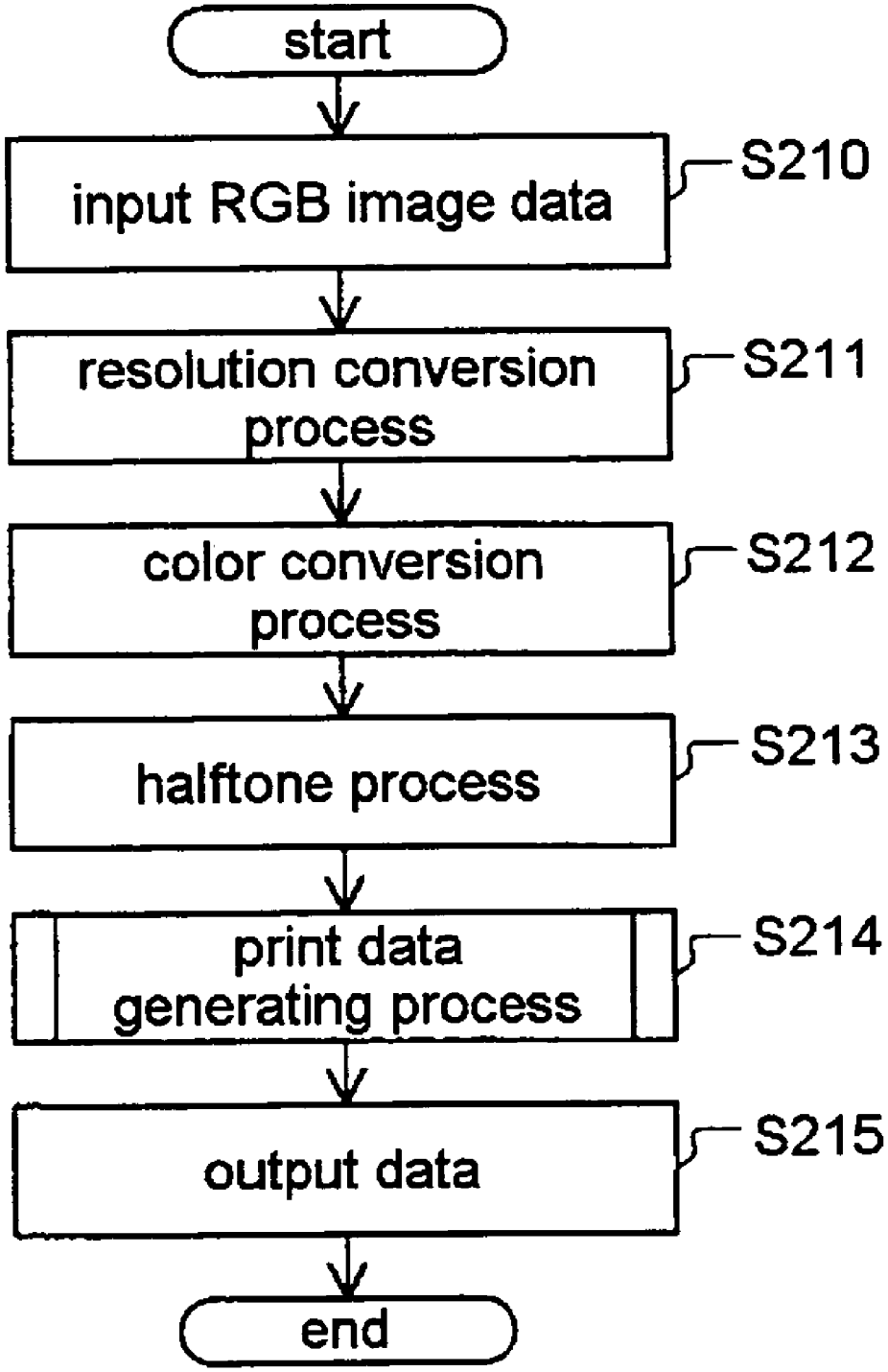
FIG. 18 is a flowchart for illustrating another example of a flow of a process executed by a printer driver program that is installed in the computer in the printing apparatus shown in FIG. 1.
Figure 19:
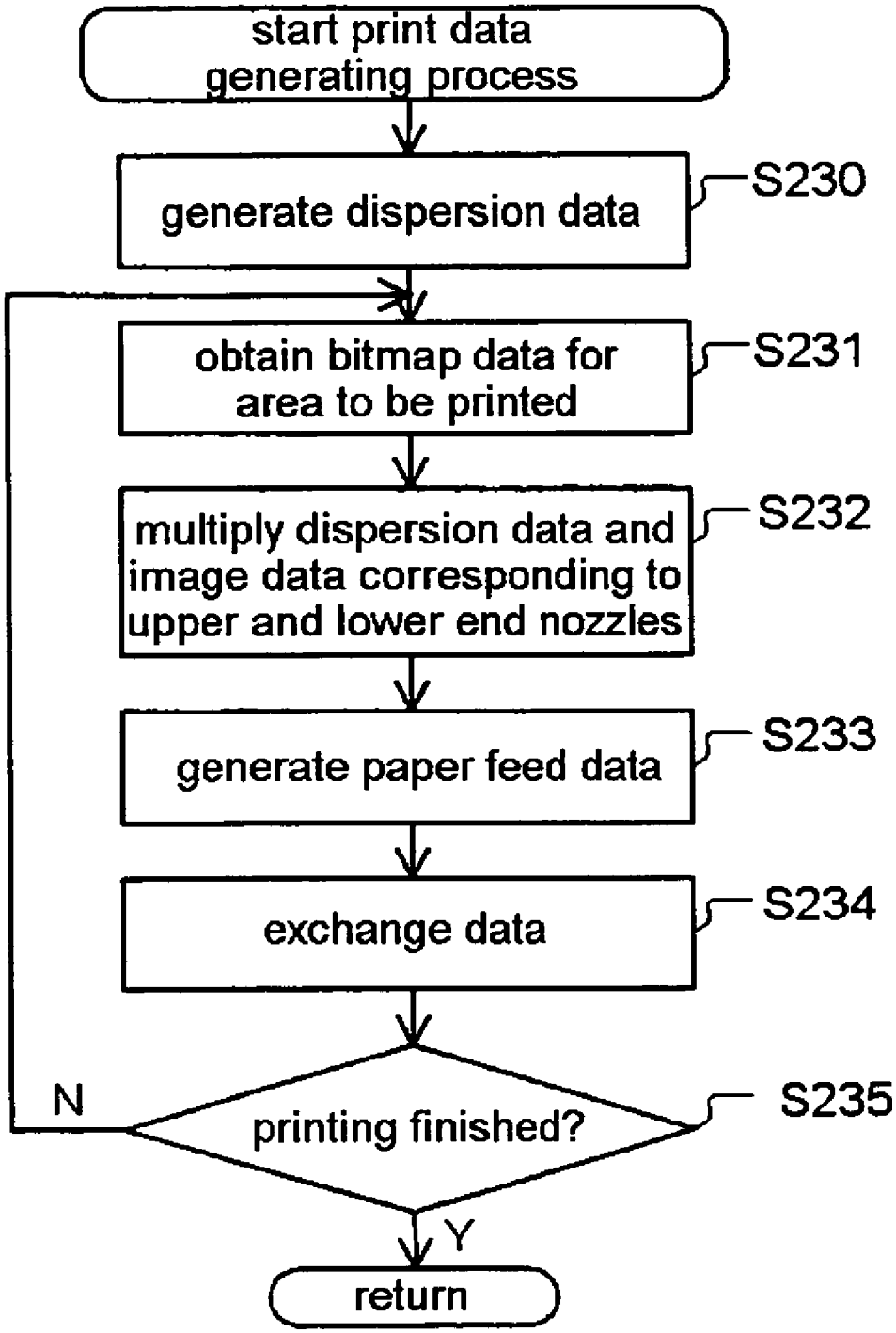
FIG. 19 is a flowchart for illustrating another example of a detailed flow of a print data generating process shown in the flowchart of FIG. 18.

Next, the print data generating process, which is step S214 in the flowchart shown in FIG. 18, is described in detail. FIG. 19 is a flowchart for illustrating the details on the print data generating process. When this flow is started, the steps described below are executed.

Step S230:

In accordance with the print data generating module 136, the CPU 91 generates dispersion data for dispersing the dots, and stores the dispersion data into the dispersion table 137.

FIG. 20 shows a diagram illustrating an example of the dispersion data. In this example, the dispersion data is made up of data that have 4×10 bits in the vertical and lateral directions, respectively, and that correspond to nozzles N1 through N4 formed in the print head 12 and serving as dot forming elements. Each bit is generated using, for example, random numbers such that the printed dot pattern becomes aperiodic, i.e., irregular. In this example, row data 137*a* corresponding to the nozzle N1 is "0110011100", and this is a complement (i.e., data in which all bits are inverted) of "1001100011", which is row data 137*d* corresponding to the nozzle N4. Row data 137*b* corresponding to the nozzle N2 and the row data 137*c* corresponding to the nozzle N3 are expressed as "-", and this indicates that computing processes are not performed therefor.

It should be noted that "aperiodic" refers to cases other than the case in which "1" appears at constant intervals (such as at every other bit), for example.

The method for generating the dispersion data may be as follows. For example, when the row data 137*a* is to be generated, data "0000000000" is first prepared as original data. Then, a random number within the range of 1 through 10 is generated, and the bit corresponding to the random number obtained is changed to "1". The same process is repeated until five bits are changed to "1". The data thus obtained is taken as the row data 137*a*, and data obtained by inverting the row data 137*a* is taken as the row data 137*d*.

It should be noted that in the example shown in FIG. 20, each row data is set such that five bits are changed to "1". This, however, is not a restriction, and it is possible to generate the dispersion data using random numbers on a bit-by-bit basis. For example, it is possible to obtain the dispersion data by generating a random number within a range of 0 through 1, setting a corresponding bit to "1" if the random number is 0.5 or larger but setting the bit to "0" if the number is less than 0.5, and performing such processes for all of the bits. Further, data for a certain row does not have to be generated by inverting data of another row, and it is possible to generate data for all rows by generating random numbers for each of them.

Step S231:

In accordance with the print data generating module 136, the CPU 91 obtains bitmap data for each color that correspond to the area to be printed. That is, the CPU 91 obtains, from the halftone module 134, the bitmap data for each color that correspond to the area that is to be printed next with one main-scanning movement.

Step S232:

In accordance with the print data generating module 136, the CPU 91 obtains raster data by extracting, from the bitmap data obtained for each color and for one main-scanning movement, bit rows corresponding to the nozzles at the upper and lower ends (i.e. N4 and N1), and multiplying the row data 137*d* and the row data 137*a* shown in FIG. 20 to those bit rows, respectively. It should be noted that if the size of the bitmap data is larger than the dispersion data, then the bitmap data may be divided into several sections each corresponding to the size of the dispersion data, and the dispersion data may be multiplied to each of those sections. More specifically, the multiplication process may be achieved through operations in which bit data in the bitmap data is extracted if the corresponding bit in the dispersion data is "1", whereas bit data is not extracted if the corresponding bit in the dispersion data is "0". It should be noted that this multiplication process is not executed for image data corresponding to the nozzles (i.e., N2 and N3) other than those at the upper and lower end nozzles, and the raster data are used as they are for those nozzles.

Step S233:

In accordance with the halftone module 134, the CPU 91 generates paper feed data. For example, the paper feed data (i.e., the sub-scanning pitch L) is set such that it becomes 3/2 times the nozzle pitch k for an odd-numbered sub-scanning movement, as described below. Further, the paper feed data is set such that it becomes half the nozzle pitch k for an even-numbered sub-scanning movement.

Step S234:

In accordance with the halftone module 134, the CPU 91 supplies, to the printer 22, the print data including the raster data generated at step S232 and the paper feed data generated at step S233.

Step S235:

In accordance with the halftone module 134, the CPU 91 determines whether or not printing has finished. If it is determined that printing is not finished, then the process returns to step S231 and the same processes are repeated, and in other cases, the process is ended.

Next, the operations of the printer 22 that has received the print data, which have been generated according to the processes described above, is described with reference to FIG. 21 through FIG. 24.

Figure 21:
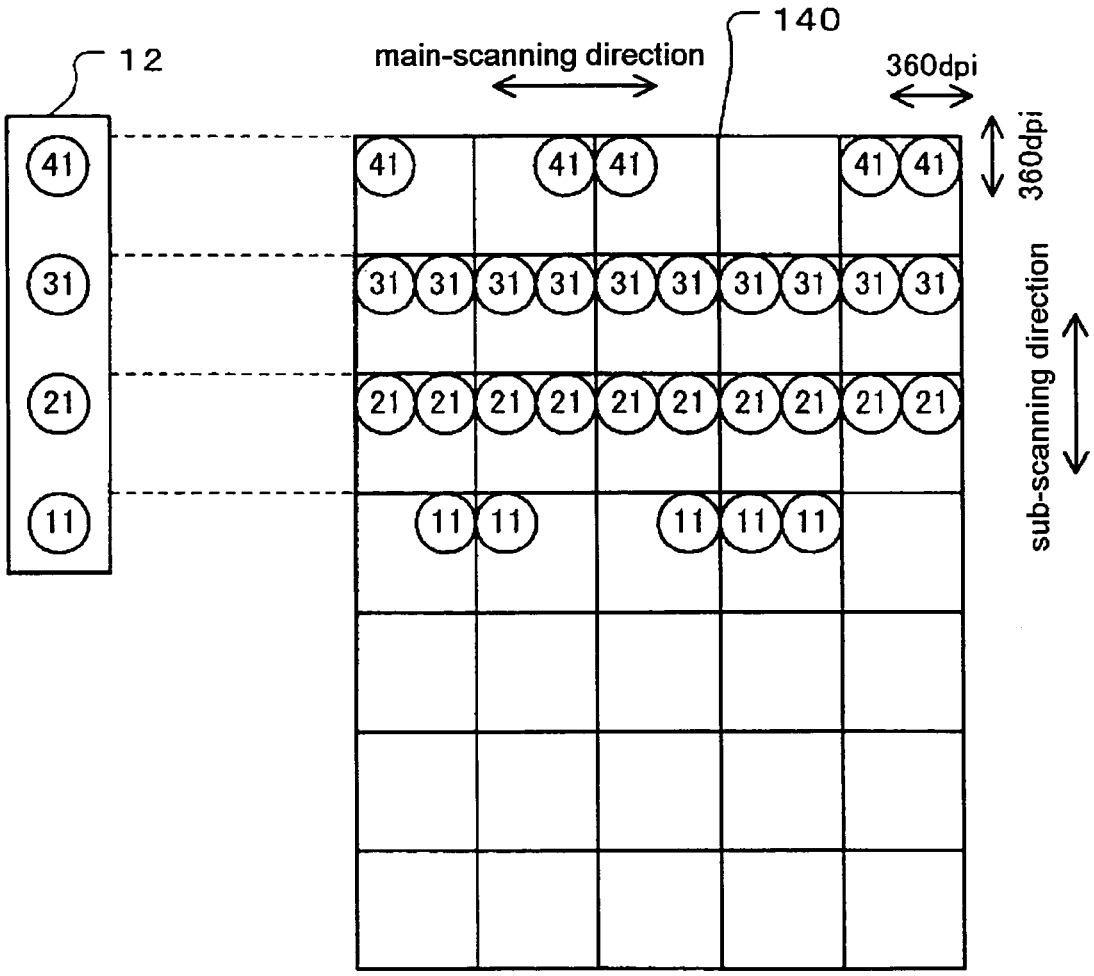
FIG. 21 is a diagram for illustrating an operation for a case in which k=2, s=2, and the number of nozzles N of the print head shown in FIG. 1 is 4, and shows a state in which dots are printed during a first scanning movement.

FIG. 21 is a diagram showing a state in which dots are printed in the first scanning movement. As shown in FIG. 21, in the first scanning movement, the print head 12 performs a scanning movement such that its nozzles N1 through N4 move along the upper end section of each of the outer borders 140 arranged in a matrix, and dots are formed, with respect to the upper section in each outer border, at positions that correspond to sections where the bit in the dispersion data shown in FIG. 20 for the upper and lower end nozzles is "1", whereas no dot is formed at positions that correspond to sections where the bit is "0". It should be noted that the nozzles (i.e., N2 and N3) other than those at the upper and lower ends print all of the dots.

Figure 22:
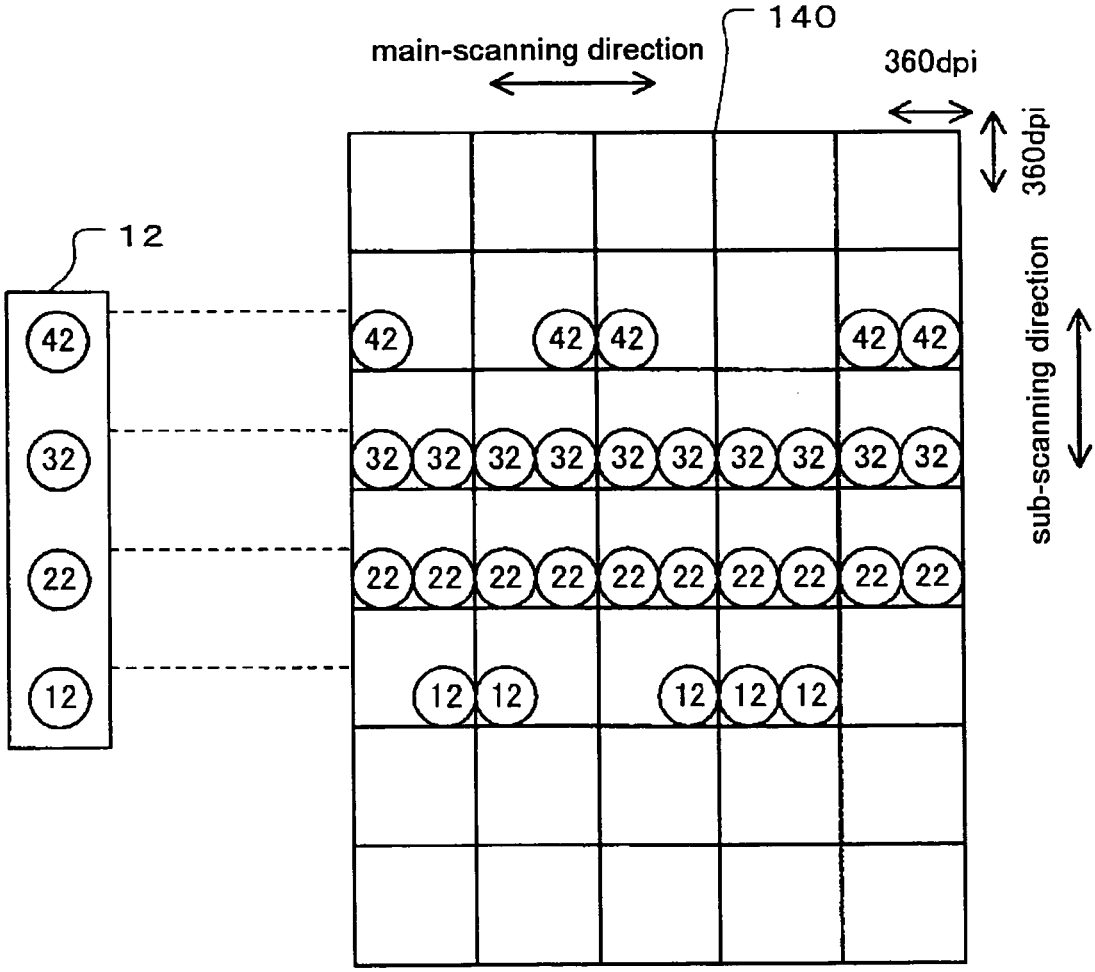
FIG. 22 is a diagram for illustrating an operation for a case in which k=2, s=2, and the number of nozzles N of the print head shown in FIG. 1 is 4, and shows a state in which dots are printed during a second scanning movement.

FIG. 22 is a diagram showing a state in which dots are printed in the second scanning movement. As shown in FIG. 22, in the second scanning movement, a sub-scanning movement for a distance corresponding to 3/2 times the nozzle pitch k is carried out, and then, dots are formed, with respect to the lower section in each outer border, at positions that correspond to sections where the bit in the dispersion data shown in FIG. 20 is "1", whereas no dot is formed at positions that correspond to sections where the bit is "0". Also in this case, the nozzles other than those at the upper and lower ends print all of the dots.

Figure 23:
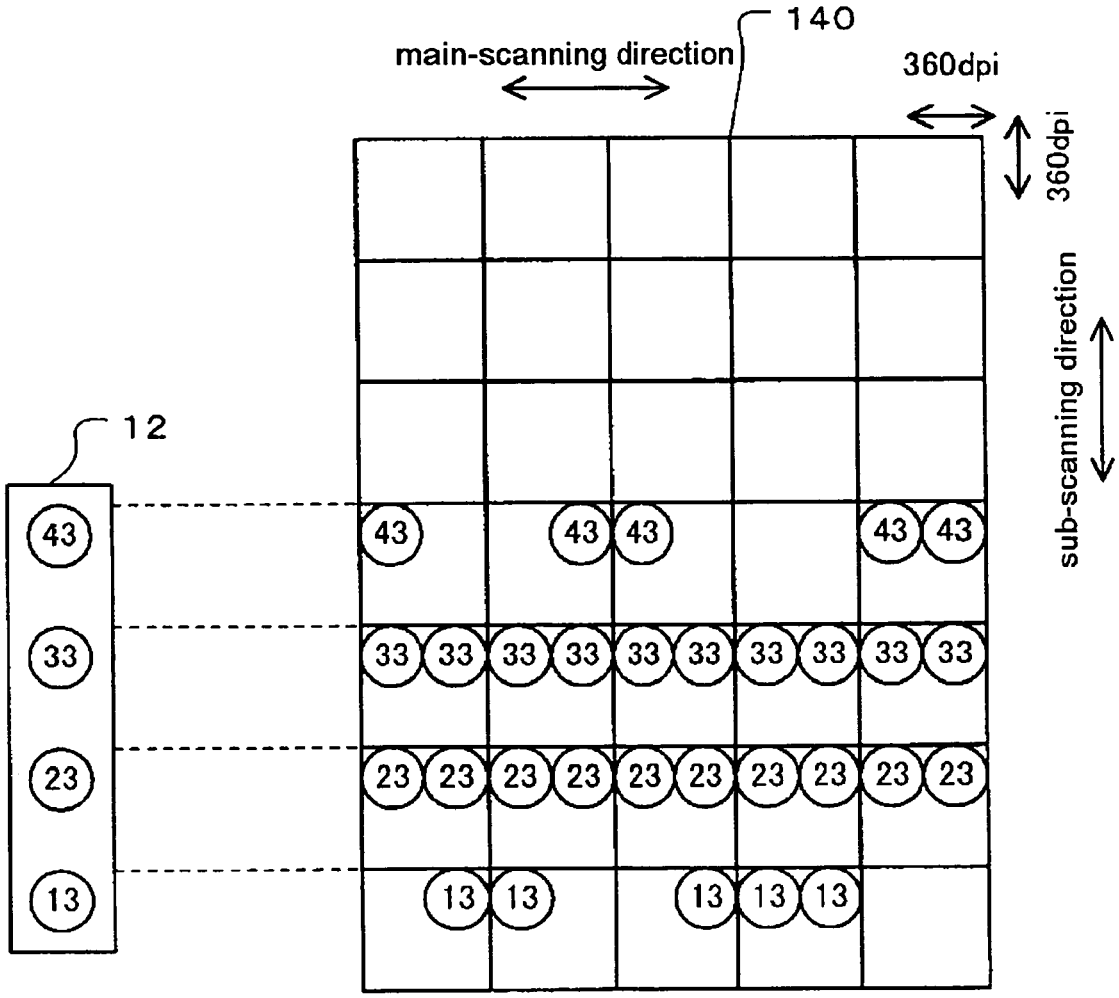
FIG. 23 is a diagram for illustrating an operation for a case in which k=2, s=2, and the number of nozzles N of the print head shown in FIG. 1 is 4, and shows a state in which dots are printed during a third scanning movement.

FIG. 23 shows a diagram for illustrating a state in which dots are printed in the third scanning movement. As shown in FIG. 23, in the third scanning movement, a sub-scanning movement for a distance corresponding to 3/2 times the nozzle pitch k is carried out, and then, dots are formed, with respect to the upper section in each outer border, at positions that correspond to sections where the bit in the dispersion data shown in FIG. 20 is "1", whereas no dot is formed at positions that correspond to sections where the bit is "0". Also in this case, the nozzles other than those at the upper and lower ends print all of the dots.

The same processes are repeated for each color, and a desired image is printed on the print paper P by repeating these processes over the entire image.

Figure 24:
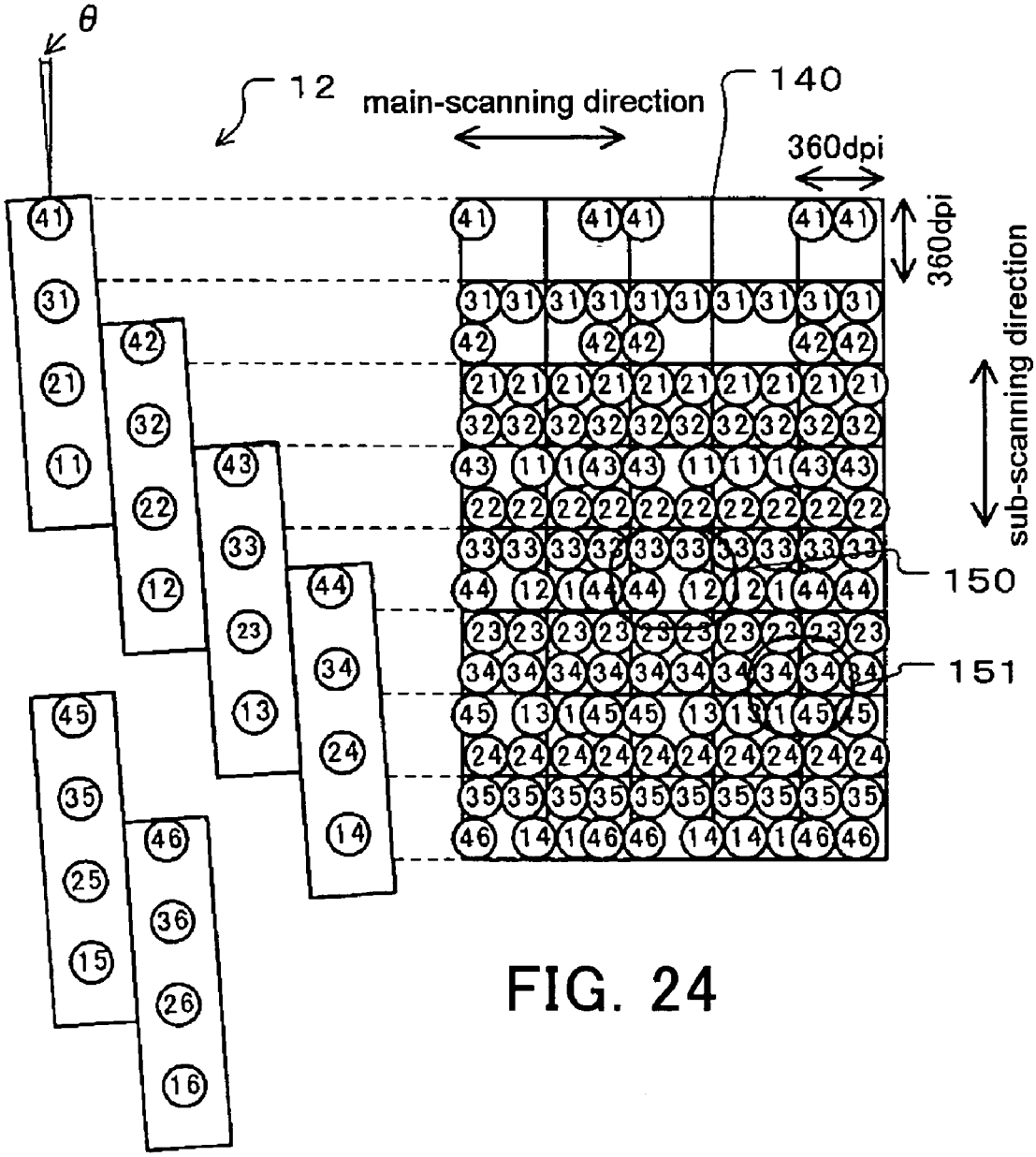
FIG. 24 is a diagram for illustrating an operation for a case in which k=2, s=2, and the number of nozzles N of the print head shown in FIG. 1 is 4, and shows a state in which dots are printed during the first through sixth scanning movements.

FIG. 24 is a diagram showing a state in which dots are formed when the print head 12 is tilted at an angle θ. As shown in FIG. 24, according to the present embodiment, even when the print head 12 is tilted by the angle θ, the sections 150 in which the dots are sparsely scattered and the sections 151 in which the dots are densely gathered are randomly dispersed. Therefore, it is possible to prevent occurrence of banding, which is caused by the dense sections and/or the sparse sections gathering on the same scan line, as is the case with the conventional art shown in FIG. 33.

Further, according to the foregoing embodiment, since the sections 150 in which the dots are sparsely scattered and the sections 151 in which the dots are densely gathered are randomly dispersed, the sharpness of an image can be reduced, thereby allowing obtainment of a soft-touch image. That is, the pixels (dots) are suitably dispersed as with silver halide photography, and therefore, it is possible to obtain an image that looks natural.

Furthermore, in the foregoing embodiment, only the image data used for printing with the nozzles at the upper and lower ends are subjected to the dispersion process. Therefore, it is possible to shorten the time until printing is started by shortening the time necessary for the dispersion process. It should be noted that the example shown in FIG. 20 exemplifies the use of only four nozzles, but in practical cases, about 180 nozzles are used. Therefore, it becomes possible to shorten the time necessary for the dispersion process by performing the dispersion process only with respect to the nozzles at the upper and lower ends.

The reason why only the nozzles at the upper and lower ends are subjected to the dispersion process is as follows. The nozzles that are arranged at positions other than the upper and lower ends have a symmetrical structure in the vertical direction because other nozzles exist on both the upper and lower sides thereof. On the other hand, as regards the nozzles at the upper and lower ends, another nozzle exists only on either the lower or upper side thereof. Therefore, these nozzles do not have a symmetrical structure in the vertical direction, and this unsymmetrical structure often causes errors. In view of such circumstances, the dispersion process is carried out with respect to the nozzles at the upper and lower ends.

It should be noted that in the foregoing embodiment, the dispersion process was carried out with respect to each one of the nozzles at the upper and lower ends. It is possible, however, to perform the dispersion process with respect to a plurality of nozzles. In this case, dispersion may be carried out using dispersion data generated by: pairing bits symmetrically with respect to the center of the row data (shown in FIG. 20), processing one of the paired bits through random number generation etc., and using a complement of the one bit for the other bit in the pair.

It should be noted that in the foregoing embodiment, an example was described in which the nozzle pitch k of the print head 12 is "2". The present invention, however, is applicable to other situations.

Figure 25:
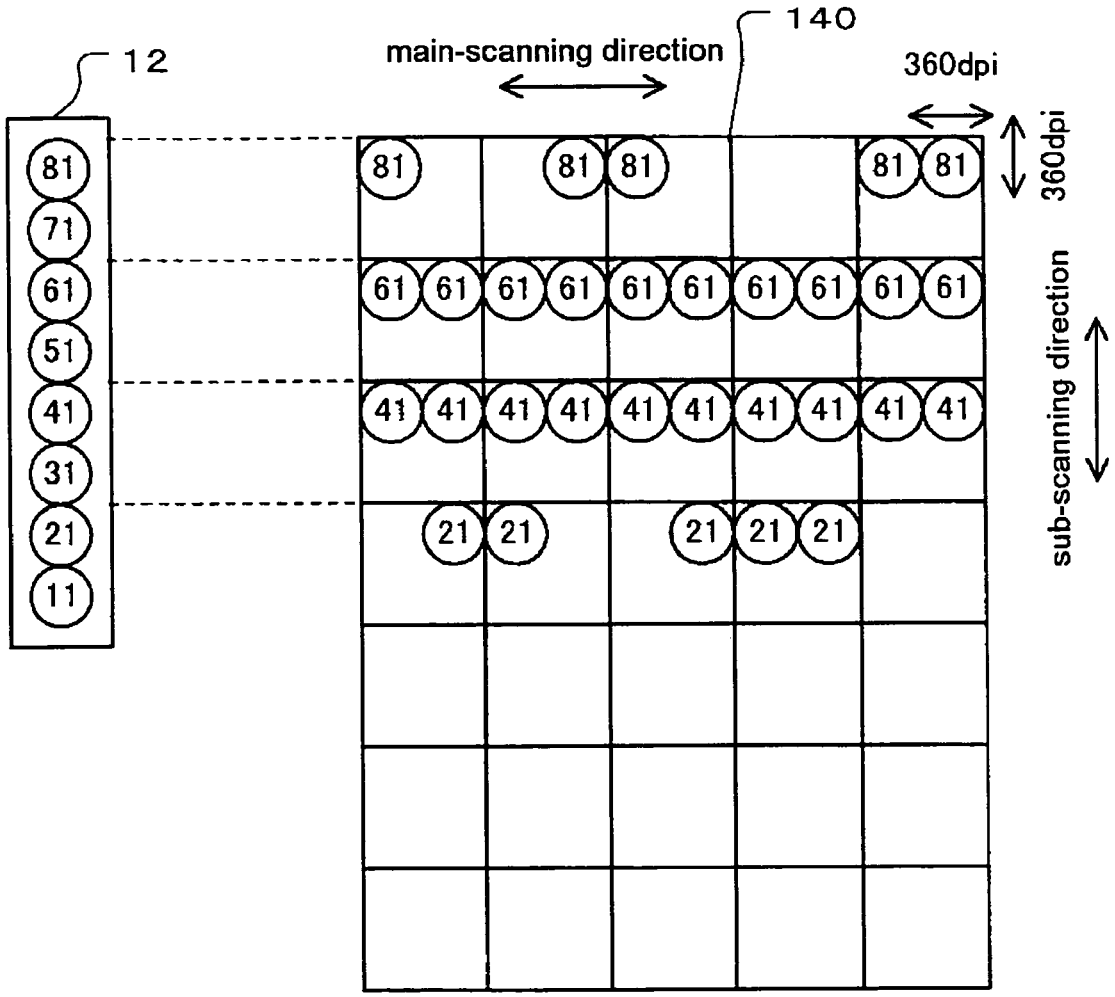
FIG. 25 is a diagram for illustrating an operation for a case in which k=1, s=2, and the number of nozzles N of the print head shown in FIG. 1 is 8, and shows a state in which dots are printed during a first scanning movement.
Figure 26:
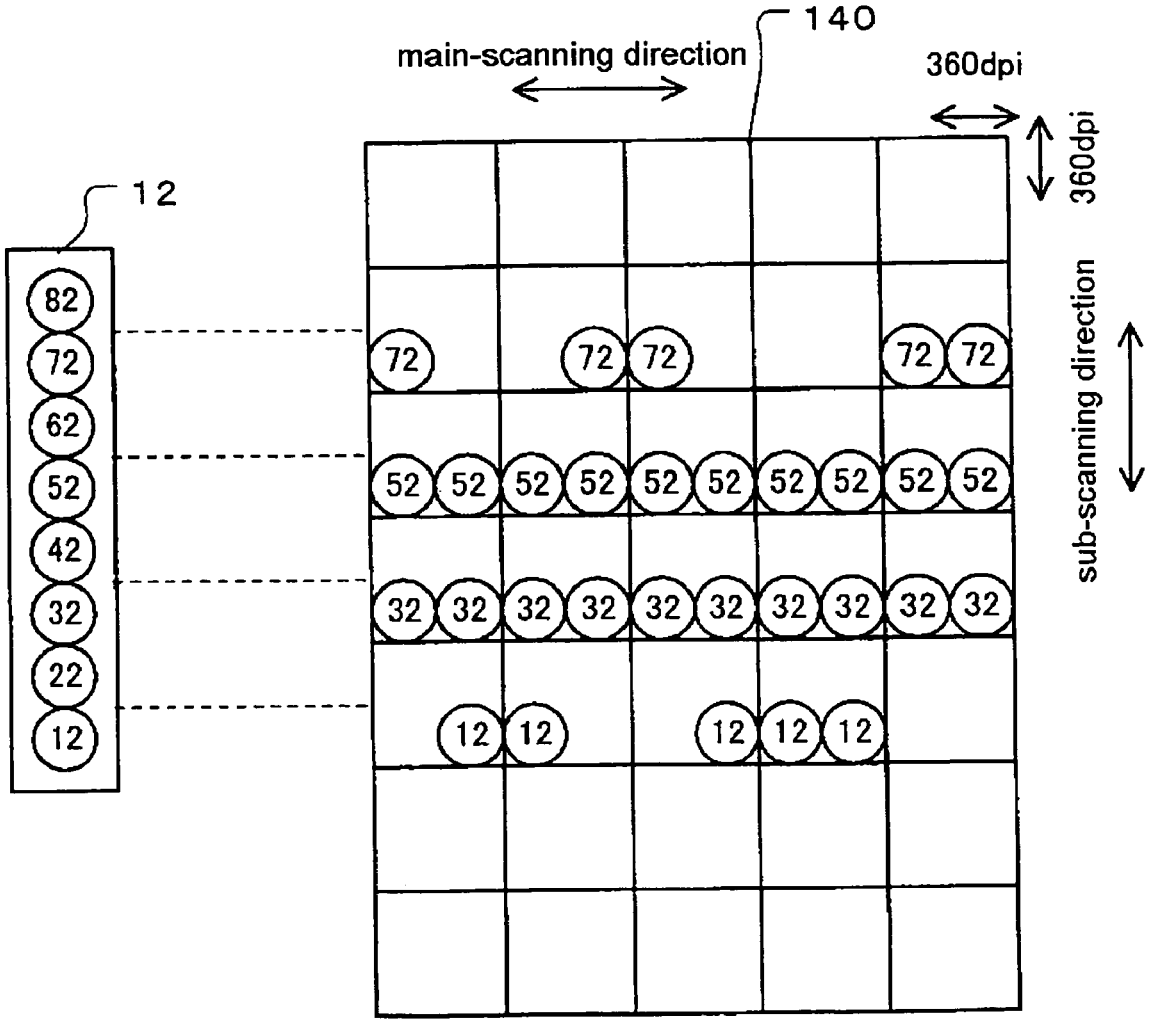
FIG. 26 is a diagram for illustrating an operation for a case in which k=1, s=2, and the number of nozzles N of the print head shown in FIG. 1 is 8, and shows a state in which dots are printed during a second scanning movement.
Figure 27:
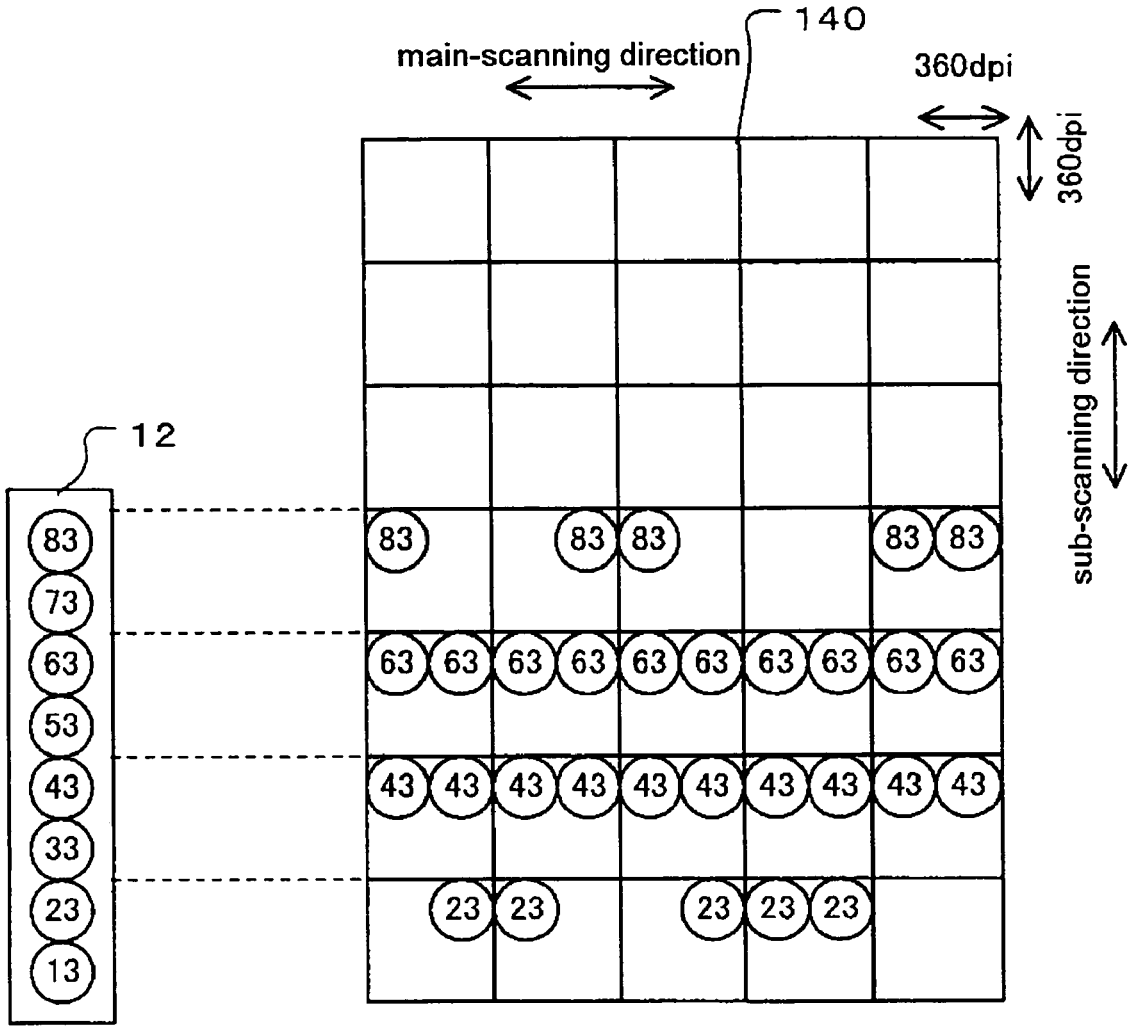
FIG. 27 is a diagram for illustrating an operation for a case in which k=1, s=2, and the number of nozzles N of the print head shown in FIG. 1 is 8, and shows a state in which dots are printed during a third scanning movement.

FIG. 25 through FIG. 27 are diagrams showing another embodiment using a print head 12A in which the nozzle pitch k is "1".

FIG. 25 is a diagram for illustrating the first scanning movement of the print head 12A in which the nozzle pitch k is "1". In the embodiment of FIG. 25, the first through eighth nozzles are arranged densely together, and the interval between the centers of two nozzles is set such that it amounts to a single pitch of a printed image (i.e., one dot pitch w).

As shown in FIG. 25, in the first scanning movement, a printing operation is carried out by the even-numbered nozzles (i.e., the second, fourth, sixth, and eighth nozzles) with respect to the upper section in each outer border such that dots are formed at positions that correspond to sections having "1" in the dispersion data shown in FIG. 20, whereas no dot is formed at positions that correspond to sections where the bit is "0". It should be noted that the nozzles other than those at the upper and lower ends print all of the dots.

Next, as shown in FIG. 26, a sub-scanning movement for a distance amounting to twice the nozzle pitch k is carried out, and then, a printing operation is carried out by the odd-numbered nozzles (i.e., the first, third, fifth, and seventh nozzles) with respect to the lower section in each outer border such that dots are formed at sections that correspond to "1" in the dispersion data shown in FIG. 20, whereas no dot is formed at sections that correspond to "0". It should be noted that the nozzles other than those at the upper and lower ends print all of the dots.

Then, as shown in FIG. 27, a sub-scanning movement for a distance amounting to twice the nozzle pitch k is carried out, and then, a printing operation is carried out by the even-numbered nozzles with respect to the upper section in each outer border such that dots are formed at sections that correspond to "1" in the dispersion data shown in FIG. 20, whereas no dot is formed at sections that correspond to "0". It should be noted that the nozzles other than those at the upper and lower ends print all of the dots.

Figure 28:
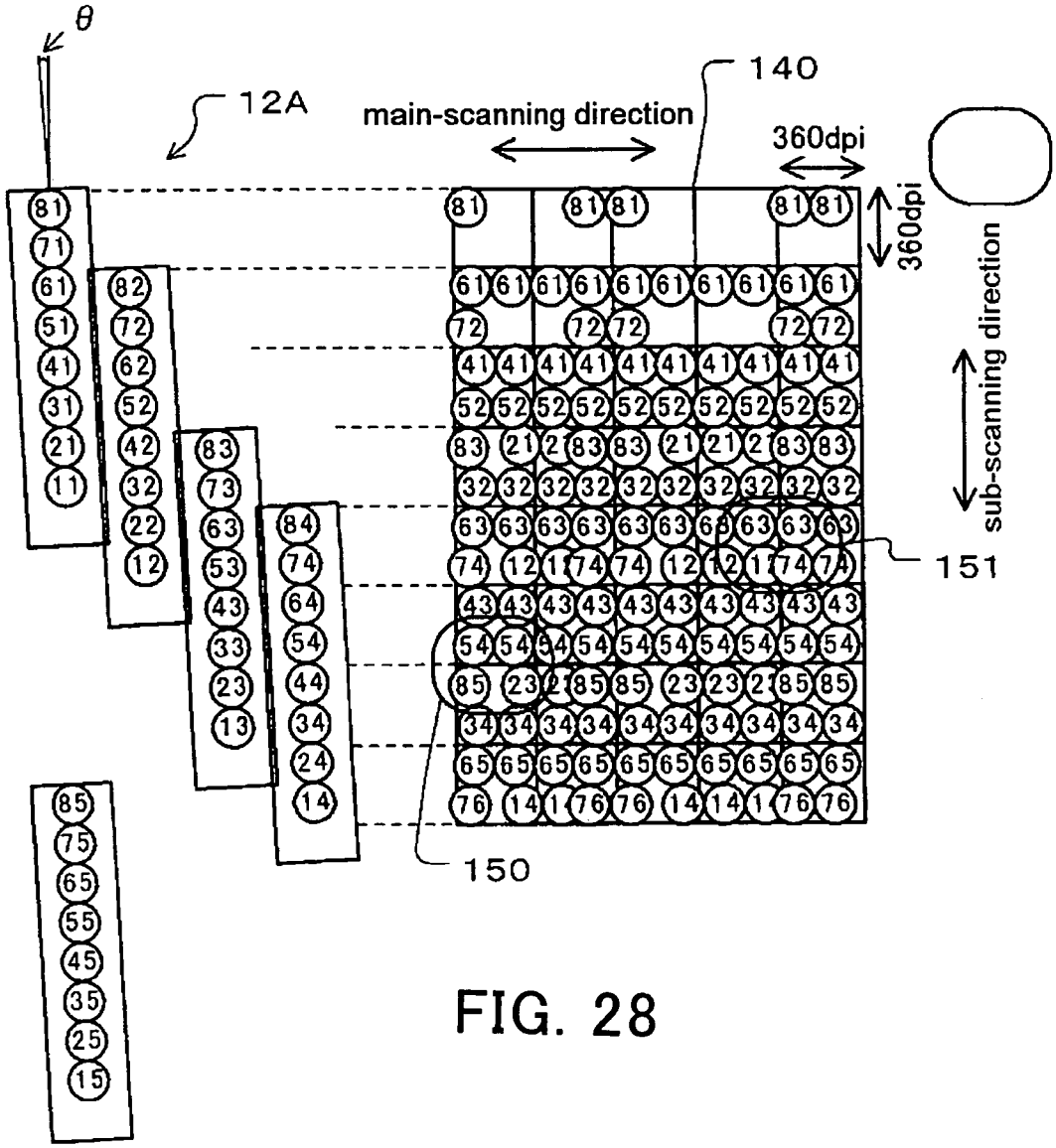
FIG. 28 is a diagram for illustrating an operation for a case in which k=1, s=2, and the number of nozzles N of the print head shown in FIG. 1 is 8, and shows a state in which dots are printed during the first through fifth scanning movements.
Figure 29:
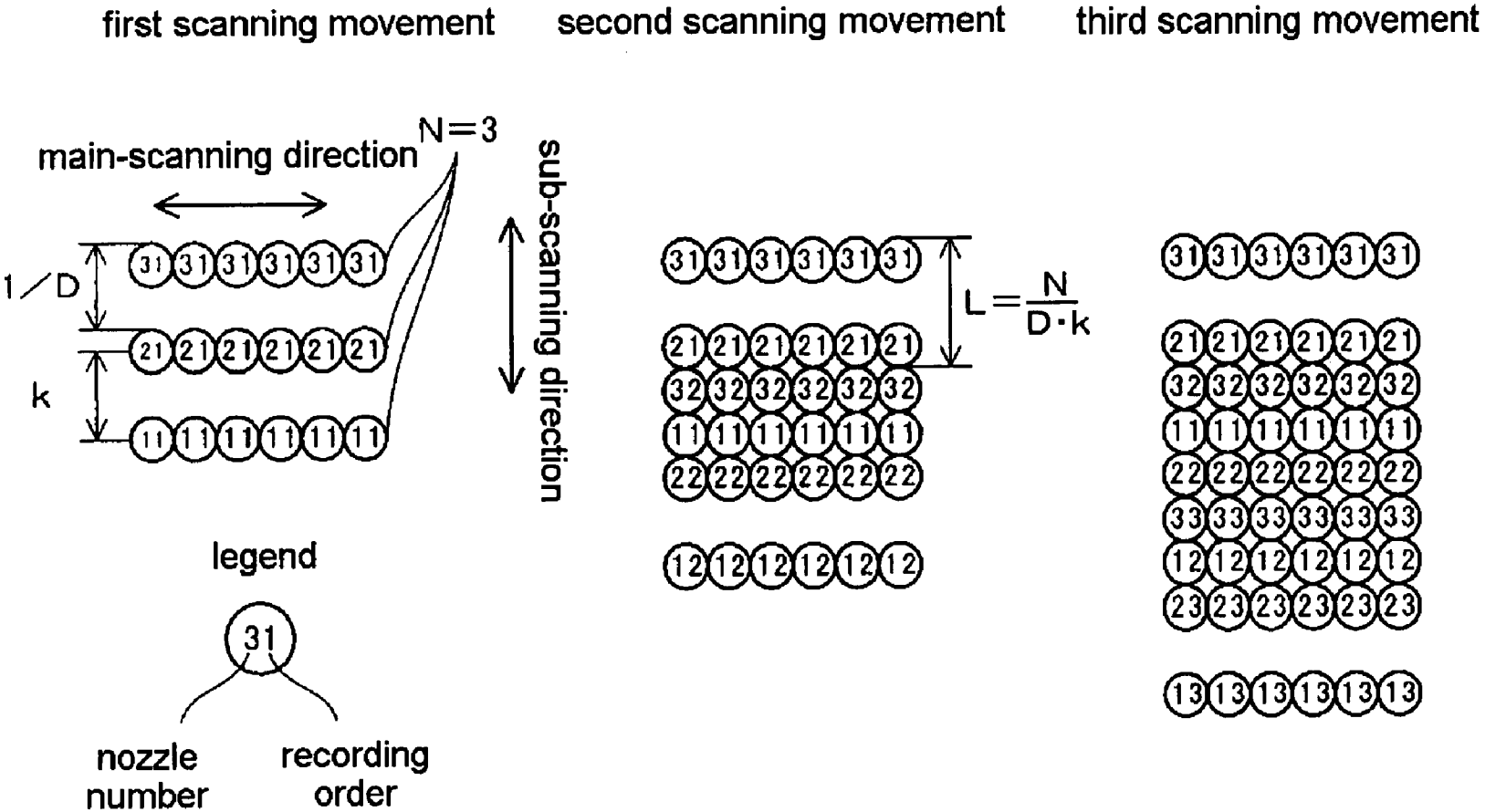
FIG. 29 is a diagram for illustrating an example of a printing method according to an interlace scheme.
Figure 30:
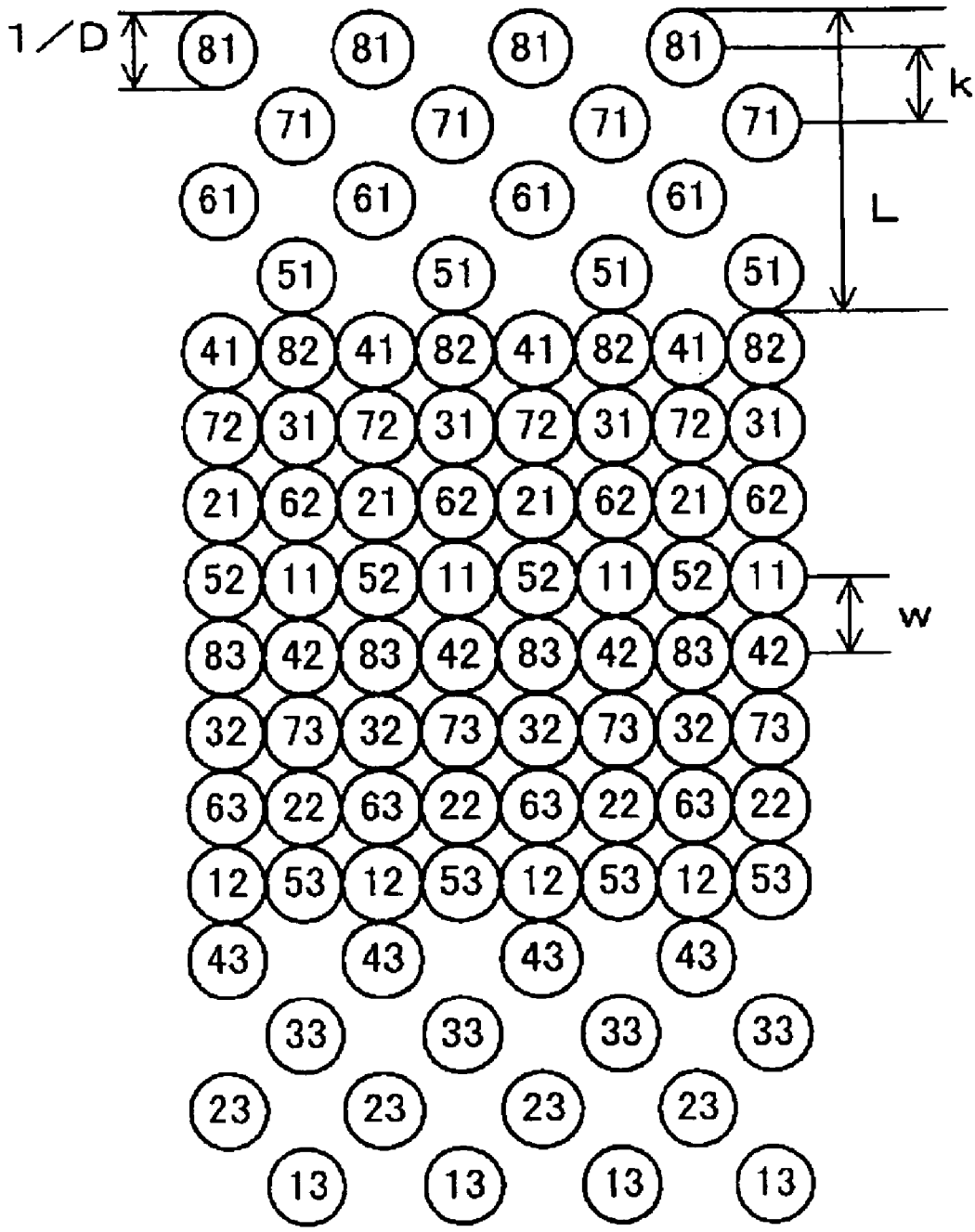
FIG. 30 is a diagram for illustrating an example of a printing method according to an overlapping scheme.
Figure 31:
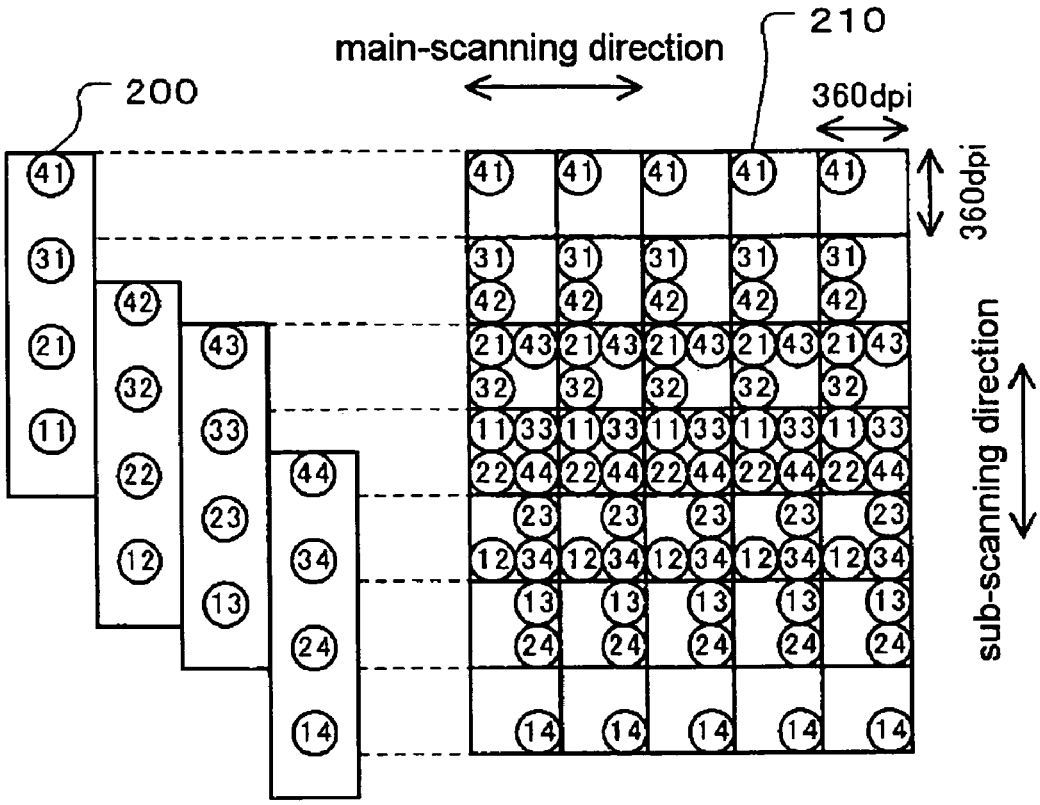
FIG. 31 is a diagram for illustrating how banding occurs, and shows a state in which dots are formed when the print head is not tilted.
Figure 32:
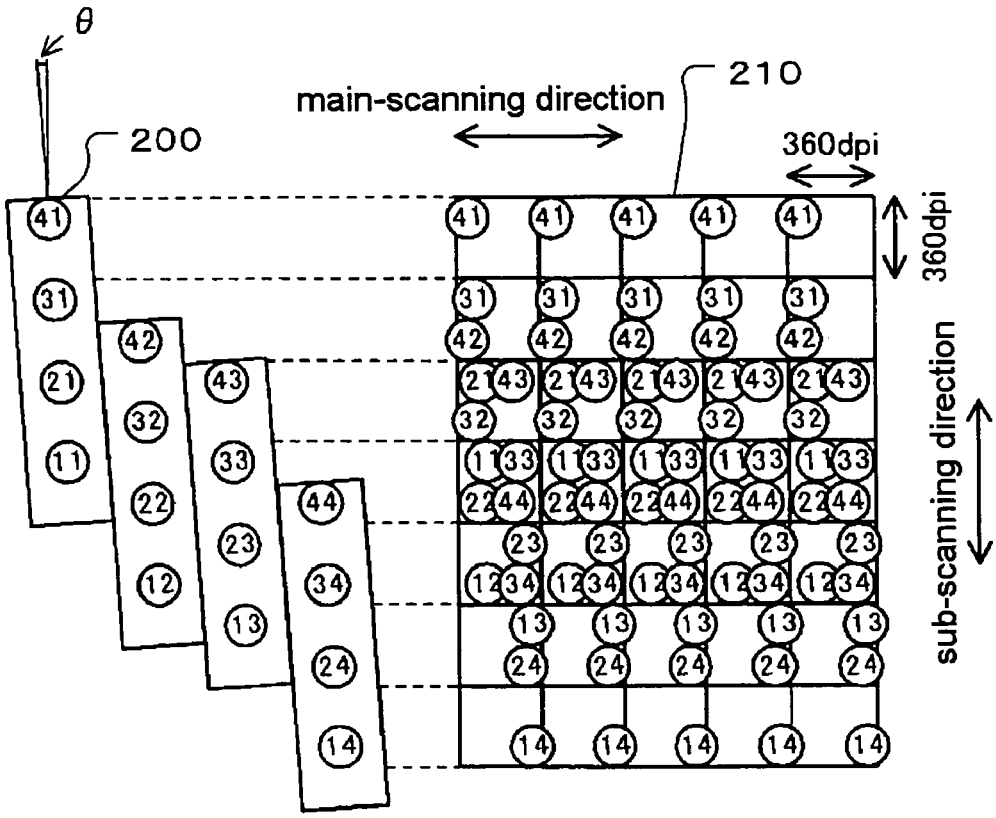
FIG. 32 is a diagram for illustrating how banding occurs, and shows a state in which dots are formed when the print head is tilted by an angle θ.

FIG. 28 is a diagram showing a state in which the dots printed in the first through fifth scanning movements have been superposed. As shown in FIG. 28, the dots arranged on each scan line do not have periodicity in which dots that are formed by the same nozzle appear in the same order, and thus, the dots are suitably dispersed. Therefore, the sections 150 in which the dots are sparse and the sections 151 in which the dots are dense are printed dispersedly.

As described above, according to another embodiment of the present invention, the dots are randomly dispersed in the print data generating module 136 using the dispersion table 137. Therefore, it is possible to prevent occurrence of banding, which is caused by the dot-sparse sections 150 and the dot-dense sections 151 gathering on the same scan line.

Further, as with the foregoing embodiment, in this embodiment, since the sections 150 in which the dots are sparsely scattered and the sections 151 in which the dots are densely gathered are randomly dispersed, the sharpness of an image can be reduced, thereby allowing obtainment of a soft-touch image. That is, the pixels (dots) are suitably dispersed as with silver halide photography, and therefore, it is possible to obtain an image that looks natural.

Furthermore, in this embodiment, by directly performing printing with the nozzles other than those at the upper and lower ends, without subjecting them to the dispersion process, it is possible to shorten the time necessary for the dispersion process, and thus, it becomes possible to shorten the time for printing.

Some embodiments of the present invention were described above, but the present invention can be modified in various ways. For example, the embodiment shown in FIG. 21 through FIG. 24 was described using an example in which the number of nozzles is N=4, the inter-nozzle pitch is k=2, and the number of times scanning is repeated is s=2, and the embodiment shown in FIG. 25 through FIG. 27 was described using an example in which the number of nozzles is N=8, the inter-nozzle pitch is k=1, and the number of times scanning is repeated is s=2. It is of course possible to apply the present invention to other situations.

Further, the foregoing embodiments were described using an example in which there is only one print head 12. It is possible, however, to arrange two or more print heads in the sub-scanning direction in such a manner that they do not interfere with each other and to print different scan lines with those print heads. For example, as for the examples shown in FIG. 21 through FIG. 24 or FIG. 25 through FIG. 28, the dots corresponding to the even-numbered nozzles may be printed with a first print head, and the dots corresponding to the odd-numbered nozzles may be printed with a second print head. With such an embodiment, it becomes possible to increase printing speed.

Further, in the foregoing embodiments, the dispersion data were generated, at step S230 shown in FIG. 19, every time a printing process is executed. It is possible, however, to generate the dispersion data and store the data in the HDD 94 in advance, and use these data. With such a process, it becomes possible to increase processing speed because it is not necessary to generate the dispersion data every time printing is carried out.

Further, in the foregoing embodiments, the same dispersion table was used for all of the colors. It is possible, however, to use dispersion tables having different patterns for each color, or to divide the colors into several groups and share the same dispersion table in each group. When dispersion tables having different patterns for each color are used, the dot-dispersion patterns will differ for each color. Thus, it becomes possible to prevent occurrence of banding even certainly by dispersing the dot-dense sections and the dot-sparse sections per each color.

Further, in the foregoing embodiments, four colors of ink in CMYK were used. It is possible, however, to use light colored inks (such as light cyan (LC) ink, light magenta (LM) ink, and dark yellow (DY) ink) in addition to, or instead of, the above-mentioned four colors of ink.

Further, in the foregoing embodiments, a printer 22 provided with a head that ejects ink using piezoelectric elements was used. It is possible, however, to use various elements other than the piezoelectric element as the ejection-drive elements. For example, the present invention is applicable to printers provided with ejection-drive elements of the type in which a current is passed through a heater arranged in the ink passage and ink is ejected using bubbles that are created inside the ink passage.

Further, in the foregoing embodiments, only the image data used for printing with one nozzle at the upper end and one nozzle at the lower end were subjected to the dispersion process. It is possible, however, to subject the image data used for printing with two or more nozzles to the dispersion process. It is also possible to increase, or decrease, the number of nozzles to be subjected to the dispersion process according to the amount of tilt of the print head 12. More specifically, the number of nozzles to be subjected to the dispersion process may be increased as the amount of tilt becomes larger. According to such a method, the dispersion process will be applied to image data used for printing with a larger number of nozzles if the amount of tilt of the print head 12 is large, and thus, it is possible to prevent occurrence of banding certainly. On the other hand, by reducing the number of nozzles to be subjected to the dispersion process when the amount of tilt of the print head 12 is small, the time necessary for the dispersion process can be shortened, thus enabling high-speed printing.

===Other Considerations===

In the foregoing embodiments, the processes described above were executed according to the printer driver program 130 stored in the HDD 94 (or the external storage device 100). It is possible, however, to store a program having the same functions in the P-ROM 43 of the printer 22 and execute the above-described processes according to this program, or to share the processes between the computer 90 and the printer 22. More specifically, it is possible to store the whole printer driver program 130 in the P-ROM 43 of the printer 22 or store only a portion of it (such as the print data generating module 136 and the dispersion table 137) in the P-ROM 43 of the printer 22.

It should be noted that the program, in which the functions of the above-described processes are described, can be recorded on a computer-readable storage medium. Examples of the computer-readable storage medium may be magnetic recording devices, optical disks, magneto-optical storage media, and semiconductor memories. Magnetic recording devices include hard disk devices (HDDs), flexible disks (FDs), magnetic tapes, and so forth. Optical disks include DVDs, DVD-RAMs (Random Access Memory), CD-ROMs, CD-Rs (Recordable), CD-RWs (Rewritable), and so forth. Magneto-optical storage media include MOs and so forth.

If the program is to be distributed, then, for example, it is possible to sell portable storage media such as DVDs and CD-ROMs having the program recorded thereon. It is also possible to store the program in a storage device of a server computer, and transfer the program from the server computer to other computers via a network.

For example, a computer that executes the program stores the program, which may have been recorded on the portable storage medium or transferred from the server computer, in its own storage device. Then the computer reads out the program from its storage device and executes processes according thereto. It should be noted that the computer could also read out the program directly from the portable storage medium and execute processes according thereto. The computer may also execute processes according to a program that it receives, every time a program is transferred from the server computer.

The present invention may be used, for example, in a printing apparatus that records on a surface of a medium using at least one print head, wherein the print head is movable in a main-scanning direction, wherein the print head includes N pieces of dot forming elements arranged at constant pitches in a sub-scanning direction, which is a direction that intersects with the main-scanning direction, wherein the N pieces of dot forming elements are for forming N dots of a same color, and wherein N is an integer of at least two.

What is claimed is:

1. A printing method comprising the steps of:

in a first movement, moving a print head to form dots on a medium at aperiodic intervals in a moving direction of said print head, wherein said print head includes N pieces of nozzles arranged at a constant pitch in a direction that intersects with said moving direction, wherein said N pieces of nozzles are for forming N dots of a same color, and wherein N is an integer of at least two;

in second through M-th movements, moving said print head to form, on said medium, the rest of the dots that were not formed in said first movement, wherein M is an integer of at least two; and repeating said first through M-th movements to print information on said medium.

2. A printing method according to claim 1, wherein each dot row that is formed on said medium and that is aligned in said moving direction is formed during said first through M-th movements by at least two different ones of said nozzles.

3. A printing method according to claim 2, wherein during said first through M-th movements, interlace printing is performed by carrying said medium at least once for a distance that corresponds to a value obtained by multiplying an integer to half the distance of said pitch at which said nozzles are arranged.

4. A printing method according to claim 2, wherein during said first through M-th movements, interlace printing is performed by forming a portion of the dots in a dot row by using said N pieces of nozzles at predetermined intervals during one movement, and forming the rest of the dots in said dot row by using the rest of said N pieces of nozzles during the rest of the movements.

5. A printing method according to claim 1, wherein a print pattern for dots formed in said moving direction during each of said first through M-th movements is different for each of said N pieces of nozzles.

6. A printing method according to claim 1, wherein a print pattern for dots formed in said moving direction during each of said first through M-th movements is different for each color.

7. A printing method according to claim 1, further comprising the steps of:

preparing at least two print heads; and performing a portion of said first through M-th movements with one of said print heads, and performing another portion of said first through M-th movements with another of said print heads.

8. A printing method according to claim 1, wherein print data that is to be supplied to each of said nozzles is generated from original image data by using dispersion data stored in a dispersion table.

9. A printing method according to claim 8, wherein:

in said dispersion data, values "1" each indicating that a dot is to be formed, and values "0" each indicating that no dot is to be formed are arranged in a matrix; and said print data is generated by multiplying said dispersion data and said original image data.

10. A printing method according to claim 9, wherein if the size of said original image data is larger than the size of said dispersion data, then said original image data is divided into a plurality of areas each corresponding to the size of said dispersion data, and said dispersion data is multiplied to each of said areas.

11. A printing method comprising the steps of:

in a first movement, moving a print head to form dots on a medium at aperiodic intervals in a moving direction of said print head, wherein said print head includes N pieces of nozzles arranged at a constant pitch in a direction that intersects with said moving direction, wherein said N pieces of nozzles are for forming N dots of a same color, and wherein N is an integer of at least two;

in second through M-th movements, moving said print head to form, on said medium, the rest of the dots that were not formed in said first movement, wherein M is an integer of at least two; and repeating said first through M-th movements to print information on said medium, wherein:

each dot row that is formed on said medium and that is aligned in said moving direction is formed during said first through M-th movements by at least two different ones of said nozzles;

during said first through M-th movements, interlace printing is performed by carrying said medium at least once for a distance that corresponds to a value obtained by multiplying an integer to half the distance of said pitch at which said nozzles are arranged;

during said first through M-th movements, interlace printing is performed by forming a portion of the dots in a dot row by using said N pieces of nozzles at predetermined intervals during one movement, and forming the rest of the dots in said dot row by using the rest of said N pieces of nozzles during the rest of the movements;

a print pattern for dots formed in said moving direction during each of said first through M-th movements is different for each of said N pieces of nozzles;

a print pattern for dots formed in said moving direction during each of said first through M-th movements is different for each color;

said method further comprises: preparing at least two print heads; and performing a portion of said first through M-th movements with one of said print heads, and performing another portion of said first through M-th movements with another of said print heads;

print data that is to be supplied to each of said nozzles is generated from original image data by using dispersion data stored in a dispersion table;

in said dispersion data, values "1" each indicating that a dot is to be formed, and values "0" each indicating that no dot is to be formed are arranged in a matrix;

said print data is generated by multiplying said dispersion data and said original image data; and if the size of said original image data is larger than the size of said dispersion data, then said original image data is divided into a plurality of areas each corresponding to the size of said dispersion data, and said dispersion data is multiplied to each of said areas.

12. A printing apparatus comprising:

a print head that is movable in a moving direction and that includes N pieces of nozzles arranged at a constant pitch in a direction intersecting with said moving direction, wherein said N pieces of nozzles are for forming N dots of a same color, and wherein N is an integer of at least two; and a controller for controlling movement of said print head, wherein:

in a first movement, said controller moves said print head in said moving direction and makes said print head form dots on a medium at aperiodic intervals in said moving direction;

in second through M-th movements, said controller moves said print head in said moving direction and makes said print head form, on said medium, the rest of the dots that were not formed in said first movement, wherein M is an integer of at least two; and said controller makes said print head repeat said first through M-th movements to print information on said medium.

13. A computer-readable storage medium having recorded thereon a computer program for a printing apparatus including a print head that is movable in a moving direction and that includes N pieces of nozzles arranged at a constant pitch in a direction intersecting with said moving direction, wherein said N pieces of nozzles are for forming N dots of a same color, and wherein N is an integer of at least two, said computer program causing said printing apparatus to achieve functions of:

in a first movement, moving said print head in said moving direction and causing said print head to form dots on a medium at aperiodic intervals in said moving direction;

in second through M-th movements, moving said print head in said moving direction and causing said print head to form, on said medium, the rest of the dots that were not formed in said first movement, wherein M is an integer of at least two; and causing said print head to repeat said first through M-th movements to print information on said medium.

14. A printing method comprising the steps of:

subjecting image data that is used for forming dots on a medium with at least one nozzle formed at an upper end, in a predetermined direction, of a print head to a first dispersion process using dispersion data, wherein said print head is movable in a moving direction, wherein said predetermined direction is a direction that intersects with said moving direction, wherein said print head includes N pieces of nozzles arranged at a constant pitch in said predetermined direction, wherein said N pieces of nozzles are for forming N dots of a same color on said medium, wherein N is an integer of at least two, and wherein said dispersion data is for aperiodically dispersing image data that is used for forming dots in one movement of said print head;

subjecting image data that is used for forming dots on said medium with at least one nozzle formed at a lower end, in said predetermined direction, of said print head to a second dispersion process using data that is obtained by inverting said dispersion data used for said first dispersion process; and supplying said image data that has been subjected to said first dispersion process, said image data that has been subjected to said second dispersion process, and image data corresponding to the nozzles that are not targeted for said first dispersion process nor said second dispersion process to said print head.

15. A printing method according to claim 14, wherein said medium is carried to form, on said medium, a line of dots by superposing dots corresponding to said image data that has been subjected to said first dispersion process and dots corresponding to said image data that has been subjected to said second dispersion process.

16. A printing method according to claim 14, wherein interlace printing is performed by alternately using said N pieces of nozzles at predetermined intervals.

17. A printing method according to claim 14, wherein the number of nozzles to be targeted for said dispersion process is increased or decreased according to an amount of tilt of said print head.

18. A printing method according to claim 14, wherein said dispersion data used for said first dispersion process is made up of a plurality of pieces of data that differ for each color.

19. A printing method according to claim 14, further comprising the steps of:

preparing at least two print heads; and supplying said image data that has been subjected to said first dispersion process to one of said print heads, and supplying said image data that has been subjected to said second dispersion process to another of said print heads.

20. A printing method according to claim 14, wherein:

said dispersion data is made up of values "1"each indicating that a dot is to be formed, and values "0" each indicating that no dot is to be formed;

said first dispersion process is performed by multiplying said image data and said dispersion data; and said second dispersion process is performed by multiplying said image data and said data that is obtained by inverting said dispersion data.

21. A printing method according to claim 20, wherein said data used in said second dispersion process is obtained by inverting the bits in said dispersion data used for said first dispersion process.

22. A printing method according to claim 20, wherein if the size of said image data is larger than the size of said dispersion data, then, in said first dispersion process and said second dispersion process, said image data is divided into a plurality of areas each corresponding to the size of said dispersion data, and said dispersion data, or said data that is obtained by inverting said dispersion data, is multiplied to each of said areas.

23. A printing method comprising the steps of:

subjecting image data that is used for forming dots on a medium with at least one nozzle formed at an upper end, in a predetermined direction, of a print head to a first dispersion process using dispersion data, wherein said print head is movable in a moving direction, wherein said predetermined direction is a direction that intersects with said moving direction, wherein said print head includes N pieces of nozzles arranged at a constant pitch in said predetermined direction, wherein said N pieces of nozzles are for forming N dots of a same color on said medium, wherein N is an integer of at least two, and wherein said dispersion data is for aperiodically dispersing image data that is used for forming dots in one movement of said print head;

subjecting image data that is used for forming dots on said medium with at least one nozzle formed at a lower end, in said predetermined direction, of said print head to a second dispersion process using data that is obtained by inverting said dispersion data used for said first dispersion process; and supplying said image data that has been subjected to said first dispersion process, said image data that has been subjected to said second dispersion process, and image data corresponding to the nozzles that are not targeted for said first dispersion process nor said second dispersion process to said print head, wherein:

said medium is carried to form, on said medium, a line of dots by superposing dots corresponding to said image data that has been subjected to said first dispersion process and dots corresponding to said image data that has been subjected to said second dispersion process;

interlace printing is performed by alternately using said N pieces of nozzles at predetermined intervals;

the number of nozzles to be targeted for said dispersion process is increased or decreased according to an amount of tilt of said print head;

said dispersion data used for said first dispersion process is made up of a plurality of pieces of data that differ for each color;

said method further comprises the steps of: preparing at least two print heads; and supplying said image data that has been subjected to said first dispersion process to one of said print heads, and supplying said image data that has been subjected to said second dispersion process to another of said print heads;

said dispersion data is made up of values "1" each indicating that a dot is to be formed, and values "0" each indicating that no dot is to be formed;

said first dispersion process is performed by multiplying said image data and said dispersion data;

said second dispersion process is performed by multiplying said image data and said data that is obtained by inverting said dispersion data;

said data used in said second dispersion process is obtained by inverting the bits in said dispersion data used for said first dispersion process; and if the size of said image data is larger than the size of said dispersion data, then, in said first dispersion process and said second dispersion process, said image data is divided into a plurality of areas each corresponding to the size of said dispersion data, and said dispersion data, or said data that is obtained by inverting said dispersion data, is multiplied to each of said areas.

24. A printing apparatus comprising:

a print head that is movable in a moving direction and that includes N pieces of nozzles arranged at a constant pitch in a predetermined direction intersecting with said moving direction, wherein said N pieces of nozzles are for forming N dots of a same color on a medium, and wherein N is an integer of at least two; and a controller for controlling movement of said print head, wherein:

said controller subjects image data that is used for forming dots on said medium with at least one nozzle formed at an upper end, in said predetermined direction, of said print head to a first dispersion process using dispersion data, wherein said dispersion data is for aperiodically dispersing the image data that is used for forming dots in one movement of said print head;

said controller subjects image data that is used for forming dots on said medium with at least one nozzle formed at a lower end, in said predetermined direction, of said print head to a second dispersion process using data that is obtained by inverting said dispersion data used for said first dispersion process; and said controller supplies said image data that has been subjected to said first dispersion process, said image data that has been subjected to said second dispersion process, and image data corresponding to the nozzles that are not targeted for said first dispersion process nor said second dispersion process to said print head.

25. A computer-readable storage medium having recorded thereon a computer program for a printing apparatus including a print head that is movable in a moving direction and that includes N pieces of nozzles arranged at a constant pitch in a predetermined direction intersecting with said moving direction, wherein said N pieces of nozzles are for forming N dots of a same color on a medium, and wherein N is an integer of at least two, said computer program causing said printing apparatus to achieve functions of:

subjecting image data that is used for forming dots on said medium with at least one nozzle formed at an upper end, in said predetermined direction, of said print head to a first dispersion process using dispersion data, wherein said dispersion data is for aperiodically dispersing the image data that is used for forming dots in one movement of said print head;

subjecting image data that is used for forming dots on said medium with at least one nozzle formed at a lower end, in said predetermined direction, of said print head to a second dispersion process using data that is obtained by inverting said dispersion data used for said first dispersion process; and supplying said image data that has been subjected to said first dispersion process, said image data that has been subjected to said second dispersion process, and image data corresponding to the nozzles that are not targeted for said first dispersion process nor said second dispersion process to said print head.

* * * * *